US008717280B2

(12) United States Patent
de Zeeuw et al.

(10) Patent No.: US 8,717,280 B2
(45) Date of Patent: May 6, 2014

(54) CONSECUTIVE DRIVING OF DISPLAYS

(75) Inventors: Cornelis Jan Hendrik de Zeeuw, Eindhoven (NL); Robert Sjang Josine van Dijk, Eindhoven (NL); Erik van Veenendaal, Eindhoven (NL); Leendert Marinus Hage, Eindhoven (NL)

(73) Assignee: Creator Technology B.V., Breda (NL)

( * ) Notice: Subject to any disclaimer, the term of this patent is extended or adjusted under 35 U.S.C. 154(b) by 295 days.

(21) Appl. No.: 12/963,358

(22) Filed: Dec. 8, 2010

(65) Prior Publication Data

US 2012/0146975 A1 Jun. 14, 2012

(51) Int. Cl.
*G09G 3/34* (2006.01)

(52) U.S. Cl.
USPC ..... 345/107; 359/315

(58) Field of Classification Search
USPC ..... 345/204–211, 107, 87–100; 359/296, 359/315–320
See application file for complete search history.

(56) References Cited

U.S. PATENT DOCUMENTS

| | | | | |
|---|---|---|---|---|
| 4,814,760 | A | 3/1989 | Johnston et al. | |
| 5,617,111 | A | 4/1997 | Saitoh | |
| 6,906,851 | B2 | 6/2005 | Yuasa | |
| 2003/0137521 | A1* | 7/2003 | Zehner et al. | 345/589 |
| 2005/0179852 | A1 | 8/2005 | Kawai | |
| 2005/0231461 | A1 | 10/2005 | Raap et al. | |
| 2005/0280626 | A1* | 12/2005 | Amundson et al. | 345/107 |
| 2007/0296690 | A1* | 12/2007 | Nagasaki | 345/107 |
| 2009/0256799 | A1* | 10/2009 | Ohkami et al. | 345/107 |

FOREIGN PATENT DOCUMENTS

| | | |
|---|---|---|
| JP | 2004-094168 | 3/2004 |
| WO | WO 01/02899 | 1/2001 |
| WO | WO 2005/034075 A1 | 4/2005 |
| WO | WO 2005/055187 A1 | 6/2005 |
| WO | WO 2008/054209 A2 | 5/2008 |
| WO | WO 2008/054210 A2 | 5/2008 |
| WO | WO 2008/153215 A1 | 12/2008 |
| WO | WO 2009/078711 A1 | 6/2009 |

OTHER PUBLICATIONS

European Patent Office, International Search Report, International Application No. PCT/NL2011/050838, Apr. 25, 2012, Europe.

* cited by examiner

*Primary Examiner* — Liliana Cerullo

(57) ABSTRACT

A lookup table provides voltage waveforms for transitions between a plurality of discrete pixel states forming a set that can be ordered in consecutive states according to a reflectivity of the pixel. An image controller repeatedly executes, in a consecutive drive phase, the steps of retrieving an initial state and update state, matching, when the initial and update states are different, in the ordered set of pixel states of the lookup table, a consecutive state and a corresponding consecutive waveform, the consecutive state forming a path, according to the consecutive drive phase, from the initial state to the update state in the set of pixel states, storing the consecutive state in the memory as new initial state; and controlling a voltage driver to drive the pixel from the initial state to the consecutive state using said consecutive waveform.

21 Claims, 15 Drawing Sheets

CONSECUTIVE DRIVING OF DISPLAYS

FIELD AND BACKGROUND OF THE INVENTION

The present invention relates to display devices, such as driving an active matrix electrophoretic display.

Displays, such as liquid crystal (LC) and electrophoretic displays include particles suspended in a medium sandwiched between a drive or pixel terminal and a common terminal. The pixel terminal includes pixel drivers, such as an array of thin film transistors (TFTs) that are controlled to switch on and off to form an image on the display. This conventional method of driving a display is referred to as scan line driving. The voltage difference (VEink=VCE−Vpx as shown in FIGS. 3 and 5) between a TFT or the pixel terminal 101 and the common terminal 102, which is on the viewer's side of the display, causes migration of the suspended particles, thus forming the image. Displays with an array of individually controlled TFTs or pixels are referred to as active-matrix displays.

In order to change image content on an electrophoretic display, such as from E Ink Corporation for example, new image information is written for a certain amount of time, such as 400 ms to 1000 ms. As the refresh rate of the active-matrix is usually higher, this results in addressing the same image content during a number of frames, such as for a frame refresh rate of 50 Hz, 20 to 50 frames. Typically, a frame represents a fixed number of times each row in a display is addressed, typically a single time.

Electrophoretic active matrix displays comprising ordered rows of display pixels are applied in many applications such as e-readers. The individual pixels in the rows are addressed via column voltages transmitted through column electrodes that are selectively transmitted to the pixels via row addressing voltages on row electrodes that may switch the pixel. Although this text refers generally to E Ink displays as examples of electrophoretic displays, it is understood that the invention can be applied to electrophoretic displays in general, such as for example SiPix displays, where the microcups are filled with white particles in a black fluid. Circuitry for driving displays, such as electrophoretic displays, is well known. Such circuitry is described in U.S. Pat. No. 5,617,111 to Saitoh, International Publication No. WO 2005/034075 to Johnson; International Publication No. WO 2005/055187 to Shikina; U.S. Pat. No. 6,906,851 to Yuasa; U.S. Patent Application Publication No. 2005/0179852 to Kawai; U.S. Patent Application Publication No. 2005/0231461 to Raap; U.S. Pat. No. 4,814,760 to Johnston; International Publication No. WO 01/02899 to Albert; Japanese Patent Application Publication Number 2004-094168; and WO 2008/054209 and WO2008/054210 to Markvoort, each of which is incorporated herein by reference in its entirety.

The grey level of a pixel will be referred to as the 'pixel state' P, and its value is measured for example by the reflectivity of the pixel. The pixel state P can be generally distributed on an equidistant partition of a dynamic range between the two extreme pixel states of the pixel (e.g., black and white states).

It will be appreciated that the term "equidistant partition of the dynamic range" may relate not only to a physically equal partition, but also to an equidistant partition as perceived by a human eye. It will be appreciated that for this purpose a known human eye sensitivity curve may be used for defining said partition.

It is recognized in the art that reflectance (R) is proportional to power and expressed in Cd/m2. The reflectance can be measured as a function of the wavelength of the light. The average reflectance between a wavelength of 350 nm and 780 nm is defined as the total reflectance of the visible light. The relative reflectance is expressed in % with respect to a reference (white for example). Luminance (Y) is the light sensitivity of human vision in Cd/m2. It is derived from reflectance as a function of the wavelength by a convolution with the eye sensitivity curve. The average value is the total luminance of the visible light. The relative luminance is expressed in % and is the luminance with respect to a reference (white for example).

Lightness (L*) is the perceptual response to the relative luminance in % and has the usual ICE definition:

$$L^*=116(R/Ro)^{1/3}-16,$$

wherein R is the reflectance and Ro is a standard reflectance value. A delta L* of unity is taken to be roughly the threshold of visibility. Grey levels in a display are preferably generated equidistant with respect to lightness L*.

The pixel state P of a pixel in an electrophoretic display remains stable when the driving voltage differential VEink is switched off (i.e., VEink=0V). This pixel state stability in the absence of driving voltage is an advantage, as it means that power is only required during a display update. However, the disadvantage is that driving an electrophoretic display is complicated: in order to drive the display one has to know the current pixel states and the intended new pixel states of the display. Typically a so-called Look Up Table (LUT) is used wherein e.g. for 16 grey levels this LUT provides 16×16 waveforms or scan line driving values, giving a recipe for a pixel to be driven from each of the 16 possible grey scales to each of these 16 grey scales.

For an update to have a desired reproducible quality, typically, current e-reader products utilize a 16×16 grey level LUT that for each transition a 'quality update' method will execute a reset in a reset phase 910 and a tuning in a tune phase 920. A pixel is driven in one of either the extreme white or the extreme black states for a resetting effect, so that a grey level can be built up in a reliable way from one of the extreme states in the tune phase, minimizing image history. The update time of such a quality update can be approximately 2 to 3 times a switching time of the display effect, which may amount to a relatively long time scale of 500 to 750 ms for E Ink (at 15V and at room temperature).

When the reset phase is skipped a pixel may be directly updated to a desired grey scale. In such a direct update a pixel is updated, with an update path of consecutive states, between the initial state and an update state that is monotonically changing to minimize the display response time; which is quicker than the above quality update but may involve a certain inaccuracy—especially when the updating is repeated over longer times. The update time of a direct update can be about a single switching time of the display effect, which may amount to a somewhat shorter update time of about 250 ms for E Ink (at 15 V and at room temperature).

Because of the underlying physics of the electrophoretic display material, the display typically requires relatively long times to adjust to a desired new grey level or pixel state. However, for certain applications, especially faster display changes are desired (e.g., in the response of the display to an input device, such as keyboard or cursor). Thus, a faster drive method is sought, where it is still possible to update the electrophoretic display to any desired pixel state, but yet seeking the potential advantage of a quicker response.

SUMMARY OF THE INVENTION

In a first aspect there is provided an electrophoretic display device comprising an electrophoretic pixel to be updated within a pixel update period from an initial pixel state to any of a set of update pixel states; a first part of a memory device storing a lookup table for storing voltage waveforms corresponding to pixel updates between pixel states; a voltage driver for supplying any of the voltage waveforms of the lookup table across the pixel; and an image controller controlling said voltage driver and comprising a second part of the memory device. The image controller is arranged for receiving the update image state and storing the initial and update image state in the second part of the memory device.

The image controller is programmed to repeatedly execute, in a consecutive drive phase, during the pixel update period, the steps of:

retrieving the initial pixel state and update pixel state from the second part of the memory device, matching, when the initial and update pixel states are different, from the set of waveforms in the lookup table, a consecutive wave form and a corresponding consecutive pixel state, according to a path defined by the consecutive drive phase, from the initial pixel state to the update pixel state, storing the consecutive pixel state in the second part of the memory device as a new initial state; and controlling the voltage driver to drive the pixel from the initial state to the consecutive state by supplying said consecutive waveform to the pixel during a consecutive update period so as to provide a consecutive update period smaller than the pixel update period.

In another aspect a method for controlling an electrophoretic display device is provided wherein an electrophoretic pixel is updated within a pixel update period from an initial pixel state to any of a set of update pixel states. The method comprises repeatedly executing, in a consecutive drive phase, during a pixel update period, the steps of:

retrieving an initial pixel state and an update pixel state from a memory, matching, when the initial and update pixel states are different, from a set of waveforms in a lookup table, a consecutive wave form and a corresponding consecutive pixel state, according to a path defined by the consecutive drive phase, from the initial pixel state to the update pixel state, storing the consecutive pixel state in the memory as a new initial state; and controlling a voltage driver to drive the pixel from the initial state to the consecutive state by supplying said consecutive waveform to the pixel during a consecutive update period so as to provide a consecutive update period smaller than the pixel update period.

In another aspect a method for controlling an electrophoretic display device is provided wherein an electrophoretic pixel is updated within a pixel update period from an initial pixel state to any of a set of update pixel states. The method comprises defining a path of consecutive pixel states from an initial pixel state to the update pixel state according to a drive phase; and setting a desired update period for a pixel update having a pixel update period in accordance with the path between the initial pixel state and the update pixel state as defined by the drive phase, the method comprising updating the pixel to a consecutive state on the path such that the consecutive update period to the consecutive state is lower than the pixel update period.

An advantage of this driving method is that updating can be provided in update periods of a consecutive update that are substantially faster than full update periods associated with a conventional pixel update phase. Such conventional pixel update periods typically have time scales on the order of 500 ms or more, wherein the image controller is arranged to execute any N×N transitions in a single full update.

Further areas of applicability of the present systems and methods will become apparent from the detailed description provided hereinafter. It should be understood that the detailed description and specific examples, while indicating exemplary embodiments of the displays and methods, are intended for purposes of illustration only and are not intended to limit the scope of the invention.

BRIEF DESCRIPTION OF THE DRAWINGS

These and other features, aspects, and advantages of the apparatus, systems and methods of the present invention will become better understood from the following description, appended claims, and accompanying drawing where in:

DETAILED DESCRIPTION

The following description of certain exemplary embodiments is merely exemplary in nature and is in no way intended to limit the invention, its application, or uses. In the following detailed description of embodiments of the present systems, devices and methods, reference is made to the accompanying drawings which form a part hereof, and in which are shown by way of illustration specific embodiments in which the described devices and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with an exception that identical components which appear in multiple figures are identified by the same reference numbers. Moreover, for the purpose of clarity, detailed descriptions of well-known devices, circuits, and methods are omitted so as not to obscure the description of the present system.

Figure 1:
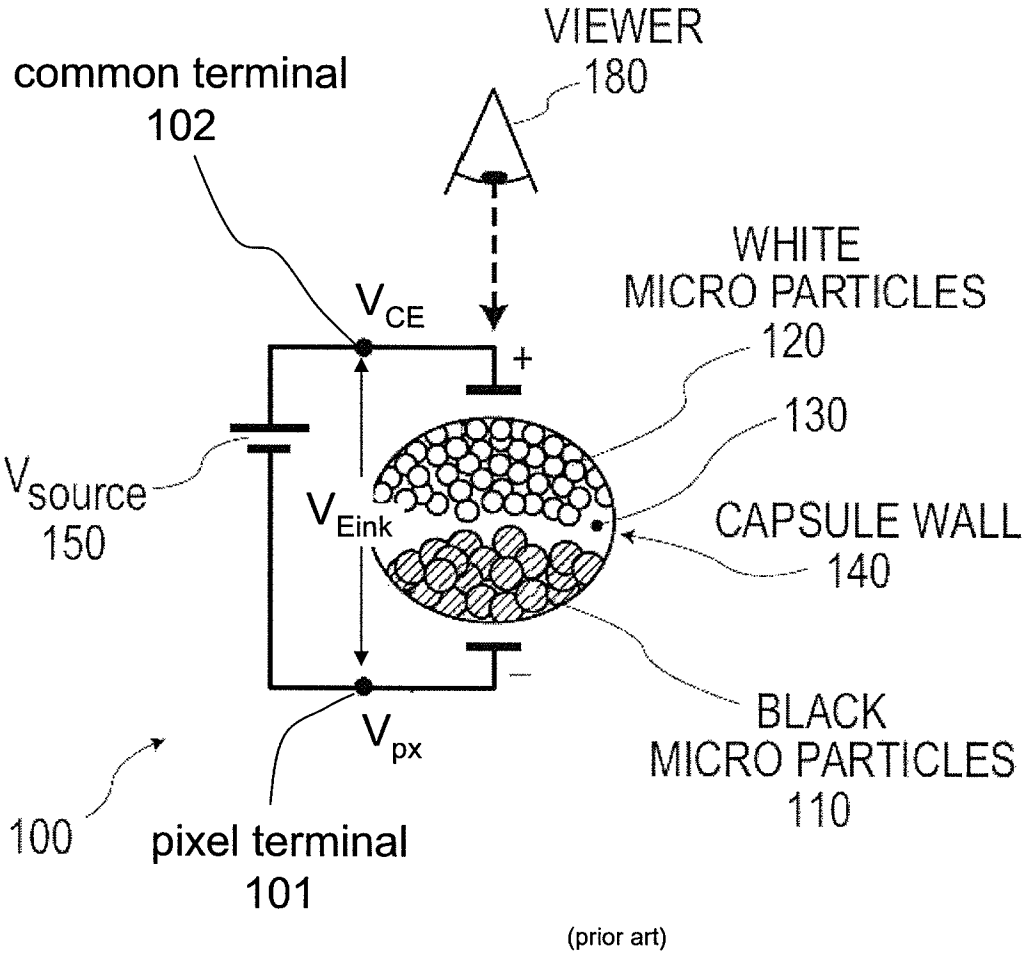
(prior art) FIG. 1
FIG. 1 shows a conventional E-ink display device.

FIG. 1 shows a schematic representation 100 of the E-ink principle, where different color particles, such as black micro-particles 110 and white micro-particles 120 suspended in a medium 130, are encapsulated by the wall of an E-ink capsule 140. Typically, the E-ink capsule 140 has a diameter of approximately 40 microns. A voltage source 150 is connected across a pixel terminal 101 and a common terminal 102 located on the side of the display viewed by a viewer 180. The voltage on the pixel terminal 101 is referred to as the pixel voltage Vpx, while the voltage on the common terminal 102 is referred to as the common voltage VCE. The driving voltage differential VEink, defined as the difference between the common voltage VCE and pixel voltage Vpx, results in an electric field over the pixel.

In the presence of an electric field the pigments in the microcapsules move in and out of the field of view; when the electric field is removed the pigments stop moving and the current grey scale is preserved; this effect is known in the art as 'bi-stable'. In this text it is assumed for conciseness that the pixels comprise positively charged black micro-particles and negatively charged white micro-particles. It is understood that any other set of first and second colors could be given to the micro-particles without affecting the working principle. Where there is written that a pixel is in a black state or in a white state, it is understood that micro-particles with a first or second color, respectively, are dominantly present on a viewing side of the pixel. Similarly where there is written that a pixel is in a grey state it is understood that a mix of any particular proportions of the first and second colored micro-particles is present on the viewing side of the pixel.

The relative sizes of the voltages applied at the pixel and common terminals determine the magnitude and the direction of the electric fields through the pixels and therewith the speed and direction of the drifting micro particles. The polarity and absolute magnitude of the voltages that are shown in the figures and text thus mainly serve an exemplary role for particular embodiments of the invention and should not be construed as limiting to its scope. Sometimes the exemplary relative absolute magnitudes of voltages for different driving modes are important because, for example, higher voltage differentials allow for faster pixel switching speeds, but may also lead to shorter lifetime of the electronic components.

Addressing of the E-ink 140 from black to white, for example in a single pixel update drive phase, requires a pixel connected between pixel terminal 101 and a common terminal 102, to be charged to −15V during 200 ms to 400 ms. That is, the pixel voltage Vpx at the pixel terminal 101 is charged to −15V, and VEink=VCE−Vpx=0−(−15)=+15V. During this time, the white particles 120 drift towards the top common terminal 102, while the black particles 110 drift towards the bottom (active-matrix, e.g., TFT, back plane) pixel terminal 101, also referred to as the pixel pad.

Switching to a black screen where the black particles 110 move towards the common terminal 102, requires a positive pixel voltage Vpx at the pixel terminal 101 with respect to the common voltage VCE. In the case where VCE=0V and Vpx=+15V, the driving voltage differential is VEink=VCE−Vpx=0−(+15)=−15V. When the driving voltage differential VEink is 0V, such as when both the pixel voltage Vpx at the pixel terminal 101 and the common voltage VCE are 0V (Vpx=VCE=0), then the E-ink particles 110, 120 do not switch or move.

Figure 2:
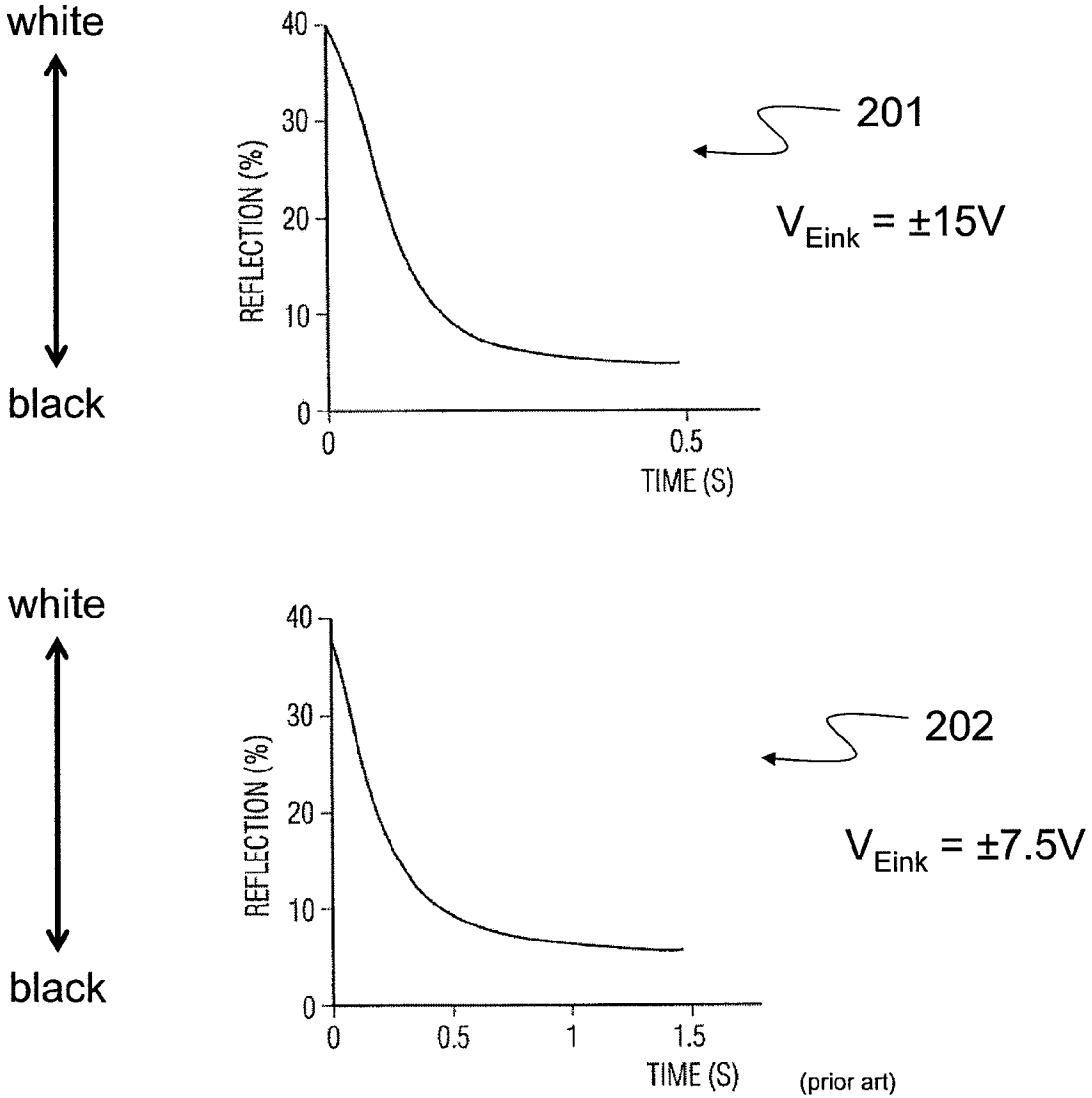
(prior art) FIG. 2
FIG. 2 shows a switching response of a pixel for different driving voltages.

FIG. 2 shows two examples of an optical switching response for a pixel, i.e. the time-dependent reflectivity for different voltages across the E-ink of that pixel. Typical driving voltage differentials VEink across the pixel are +15V, 0V and −15V. For such voltage levels, the optical switching characteristic of percent reflection versus time is shown in curve 201 of FIG. 2, where the switching time is approximately 0.25 seconds. This reflection is caused by white micro particles that are present on the viewing side of the pixel, while the black micro particles are absorbing.

If the voltages are reduced from 15V to 7.5V, then switching time is increased to approximately 0.65 seconds, as shown by the curve 202 of FIG. 2. It should be noted that both curves 201, 202 shown in FIG. 2 have the same behavior or shape; the difference between the two curves 201, 202 is the transition speed, namely, approximately 0.25 seconds for the curve 201 associated with the higher voltage levels of VEink=±15V, and approximately 0.65 seconds for the curve 202 associated with the lower voltage levels of VEink=±7.5V.

Figure 3:
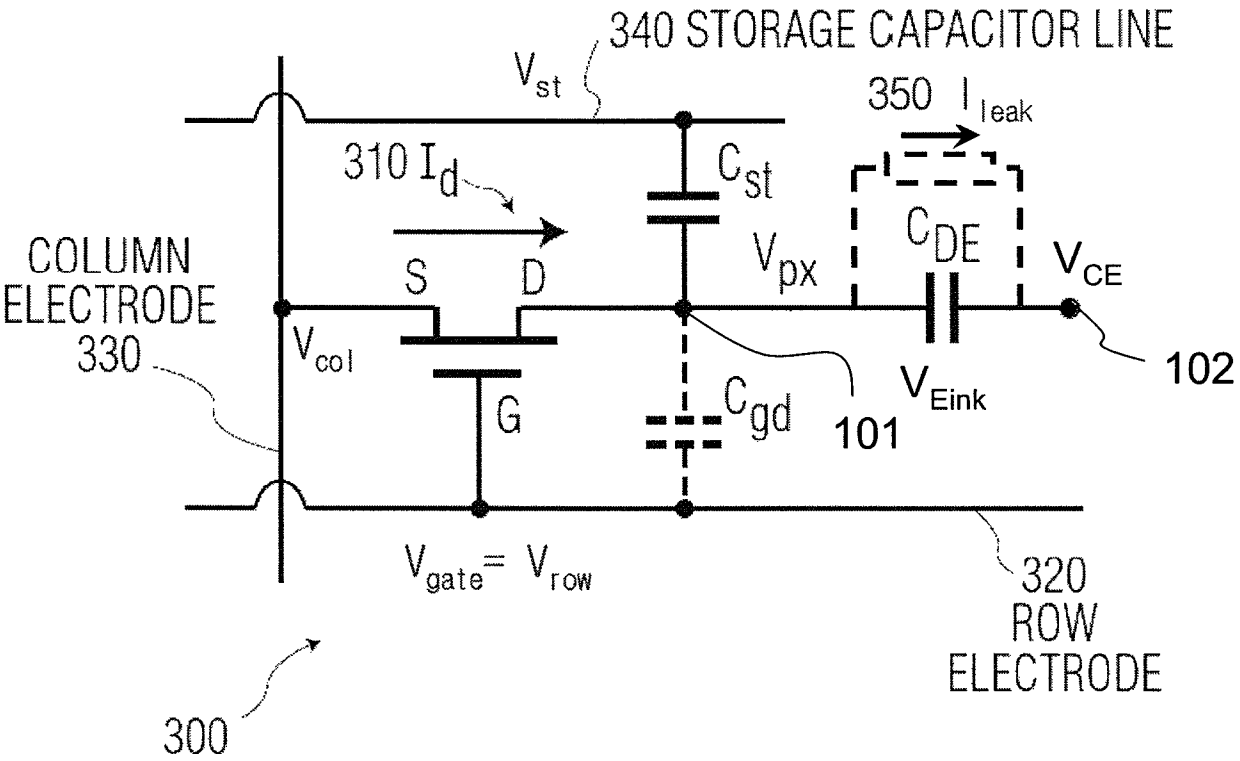
(prior art) FIG. 3
FIG. 3 shows an equivalent circuit of a pixel in a conventional active-matrix display.

FIG. 3 shows an equivalent circuit 300 for driving a pixel, represented by capacitor CDE, in an active-matrix display. A pixel is selected by applying the appropriate select voltage to the select line or row electrode 320 connected to the transistor of that pixel.

The transistor may be a TFT 310, for example, which may be a MOSFET transistor, as shown in FIG. 3, and be controlled to turn ON or OFF (i.e. switch between a conducting state, where current Id flows between the source S and drain D, and non-conducting state) by row select and non-select voltages, respectively, applied to row electrodes 320 connected to their gates G, referred to as Vrow or Vgate. The sources S of the TFTs 310 are connected to column electrodes 330 where data or image voltage levels, also referred to as the column voltage Vcol are applied.

The TFT 310 conducts when a select voltage from the row electrode is applied to the TFT gate G resulting in the flow of current Id through the TFT 310 (or switch 510) between its source S and drain D. In this text, gate voltages for the TFTs or transistors are shown as they are for an organic electronics active-matrix back plane with p-type TFTs. In that case, the transistor is brought into a non-conducting state by applying a non-select voltage to the gate G which is higher than the voltages at the source S or drain D. The transistor is brought into a conducting state by applying a select voltage to the gate G which is lower than the voltages at the source S or drain D. It is noted that for n-type TFTs (e.g. amorphous silicon), the polarity of the gate voltages, compared to the source and/or drain voltages, would be opposite.

As shown in FIG. 3, various capacitive elements are connected to the drain of the TFT 310. First there is the pixel itself which is represented by a display effect capacitor CDE that contains the display effect also referred to as the pixel capacitor. In order to hold the charge or maintain the level of pixel voltage Vpx (at pixel terminal 101 to remain close to the level of the column voltage Vcol) between two select or TFT-ON states, i.e. during the hold time, a storage capacitor Cst may be provided between the TFT drain D and a storage capacitor line 340. Instead of the separate storage capacitor line 340, it is also possible to use the next or the previous row electrode as the storage capacitor line. Finally due to parasitic effects a gate-drain parasitic capacitor Cgd between the TFT gate G and drain D is schematically shown in dashed lines in FIG. 3.

As current Id flows through the TFT, the storage capacitor Cst is charged or discharged until the voltage potential of pixel terminal 101 at the TFT drain D equals the potential of the column electrode, which is connected to the TFT source S. If the row electrode potential is changed, e.g., to a positive voltage, then the TFT or switch will close or become non-conductive, and the charge or voltage at the pixel terminal 101 will be maintained and held by the storage capacitor Cst. That is, the potential at the pixel terminal 101, referred to as the pixel voltage Vpx at the TFT drain D will be substantially constant at this moment as there is no current flowing through the TFT 310 in the open or non-conductive state.

It should be noted that the storage capacitor Cst in an active-matrix circuit designed to drive the E-ink (or pixel/display effect capacitor CDE) is 20 to 60 times as large as the display effect capacitor CDE. Typically, the value of the display effect capacitor CDE is small due to the large cell gap of the E-ink. The E-ink material exhibits a relatively large leakage current. The leakage current Ileak can be represented by a resistor 350 in parallel with the display effect capacitor CDE. Because of the small value of the display effect capacitor CDE and the leakage current, a relatively large storage capacitor Cst may be required.

Figure 4:
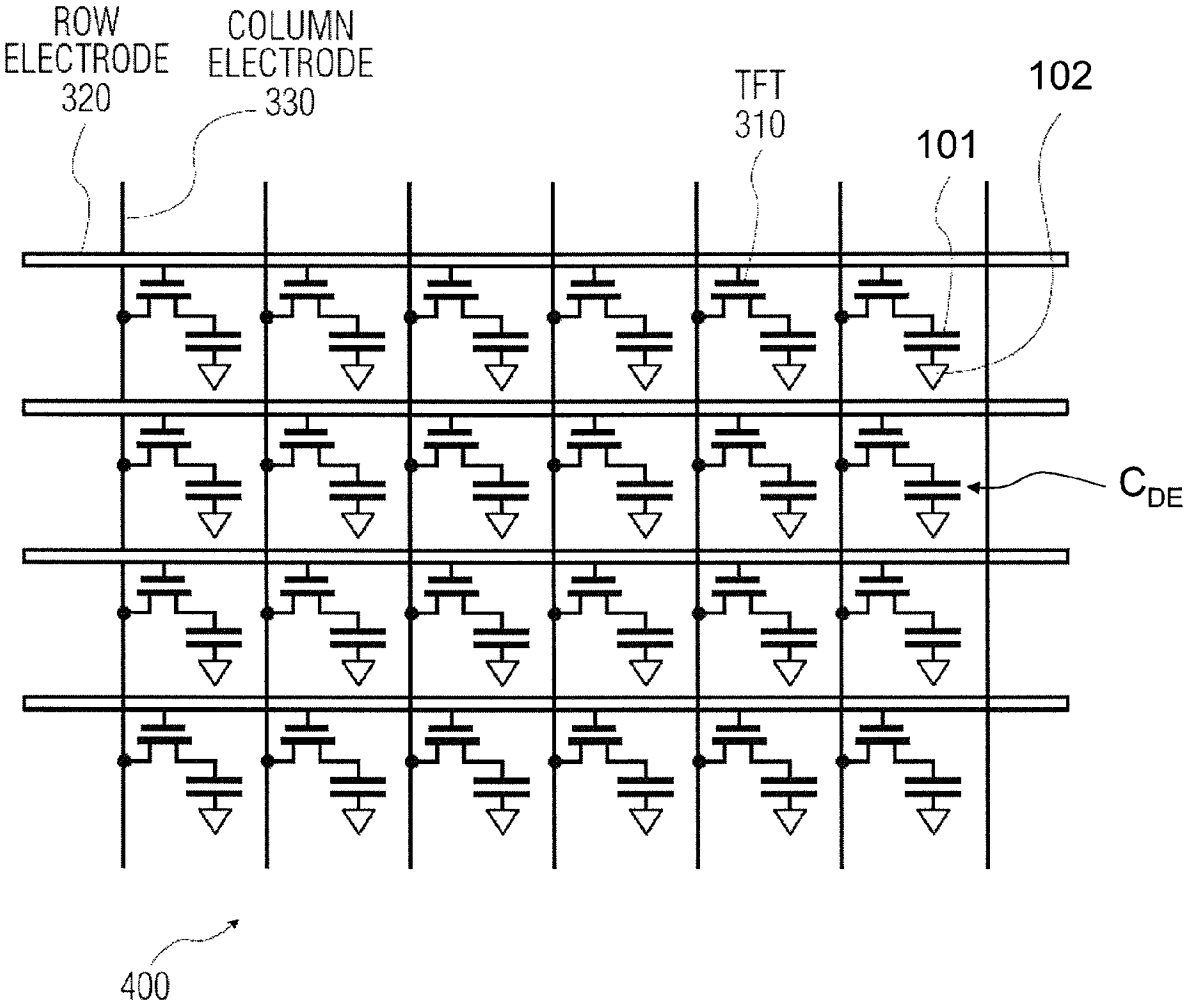
FIG. 4 (prior art)
FIG. 4 shows an array of cells of an active-matrix display.

FIG. 4 shows a matrix or array 400 of cells that include one TFT 310 per cell or pixel. When a row of pixels is selected, a desired voltage may be applied to each pixel CDE via its data line or column electrode 330. When a pixel is selected, it is desired to apply a given voltage to that pixel alone and not to any non-selected pixels. The non-selected pixels should be sufficiently isolated from the voltages circulating through the array for the selected pixels. External controllers and drive circuitry are also connected to the cell matrix 400. The external circuits may be connected to the cell matrix 400 by flex-printed circuit board connections, elastomeric interconnects, tape-automated bonding, chip-on-glass, chip-on-plastic and other suitable technologies. Of course, the controllers and drive circuitry may also be integrated with the active matrix itself.

Figure 5:
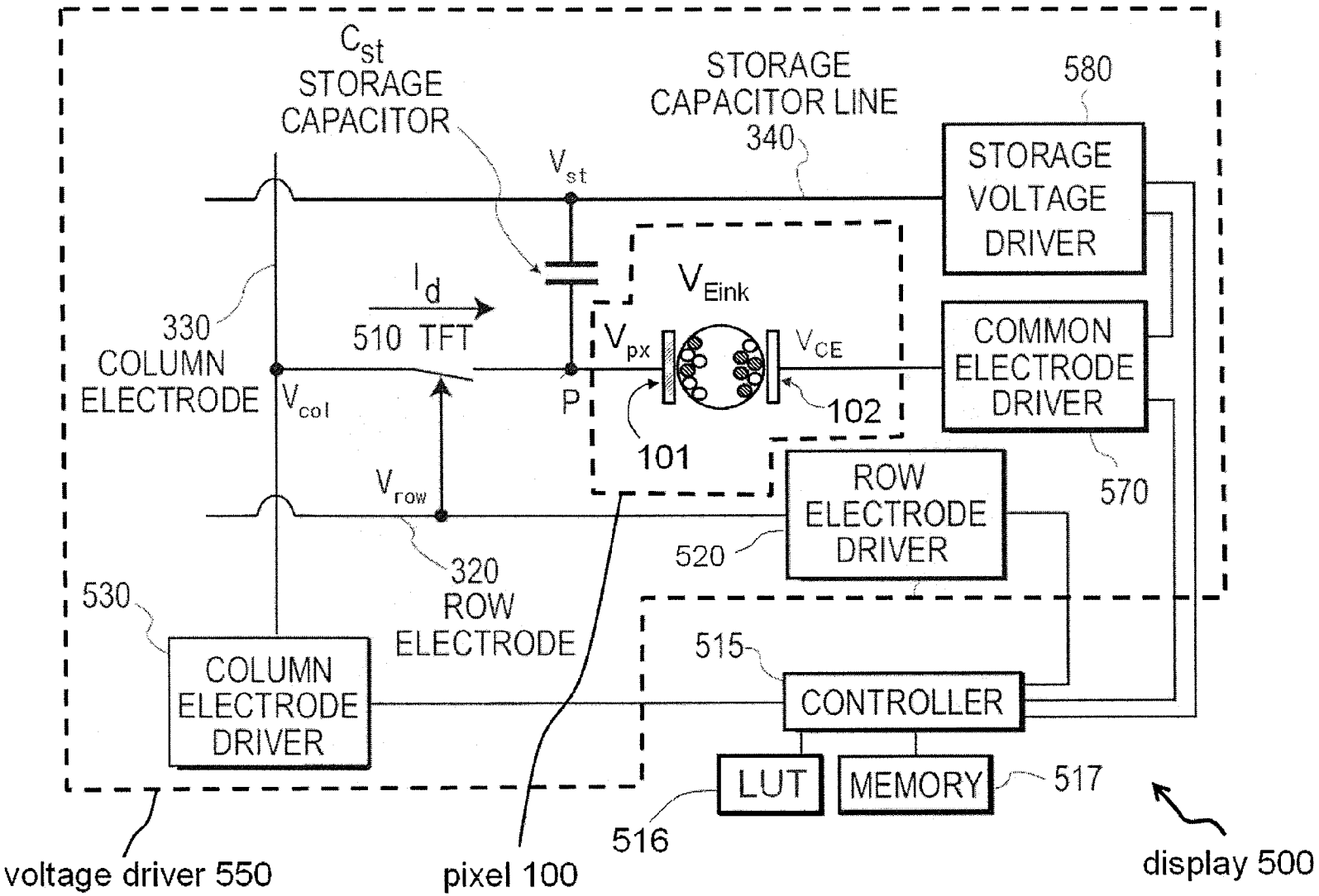
FIG. 5 shows a simplified circuit for the active matrix pixel circuit according to one embodiment of the present invention.

FIG. 5 shows a simplified circuit 500 similar to the active matrix pixel circuit 300 shown in FIG. 3, where the TFT 310 is represented by a switch 510 controlled by a signal from the row electrode 320, and the electrophoretic pixel 100 connected between one end of the TFT switch 510 and the common terminal 102 with a pixel terminal 101 and a common terminal 102, respectively. The other end of the TFT switch 510 is connected to the column electrode 330. The electrophoretic pixel 100 is updated within a pixel update period (detailed further below) from an initial pixel state to any of a set of update pixel states which are stored in a memory 517 according to a pixel state ordering that is equidistant in a dynamic range as perceived by a human eye as previously explained.

The various electrodes may be connected to voltage supply sources and/or drivers which may be controlled by an image controller 515 (also referred to as a control/processor 515, and processor 515 herein below) that controls the various voltage supply sources and/or drivers, shown as reference numerals 520, 530, 570, connected to the row electrode 320, the column electrode 330, and the common terminal 102, respectively. The controller 515 is adapted to access a first part of a memory device storing a lookup table (LUT) 516 and a second part 517 of a memory device storing pixel states (e.g. the initial pixels state, the update pixel state, and/or the consecutive pixel state) and to control the voltage driver 550, e.g. with pulses having different voltage levels (i.e. voltage waveforms) that distinguish control sequences of various driving phases. In the following, the first part of the memory device storing the lookup table will also be referred to as the 'lookup table 516'. The second part of the memory device storing pixel states will also be referred to as the 'memory 517'. Both the lookup table 516 and the memory 517 can be part of a single memory device or be located on separate memory devices.

The image controller is typically connected to circuitry (not shown) arranged for transmitting image states, so that the controller receives initial states and update states for the pixels to be stored in the memory 517. While the waveforms stored in lookup table 516 will be further detailed below, in effect, voltage driver 550 is arranged for supplying any of the voltage waveforms of the lookup table 516 across the pixel 100.

While in effect the voltage driver 550 can be designed as a single 'driver', which can supply any of the voltage waveforms of the lookup table across the pixel, in the shown embodiment the voltage driver 550 comprises a plurality of sub systems that work in synchronicity:

- a row electrode driver 520 for supplying a row voltage Vrow or Vgate to the row electrode 320 and the gate terminal G of the TFT 310 or switch 510;
- a column electrode driver 530 for supplying a column voltage Vcol or data/image voltage to the column electrode and the source of the TFT 310 or switch 510;
- a common electrode driver 570 for supplying a common voltage VCE to the common electrode and common terminal 102 of the pixel 100; and
- a storage voltage driver 580 for supplying a storage voltage Vst to the storage capacitor line 320 or storage capacitor Cst.

To realize the proper amount and timing of changes of the voltages of the storage capacitor voltage Vst and common voltage VCE, the common terminal 102 driver 570 may be connected to the storage capacitor line 340 through a storage driver 580 which may be programmable or controllable by the controller 515. In this case the storage driver 580 is a scaler which generates an output signal Vst that is proportional to the common voltage VCE. In other words, the voltage Vst of the output signal varies proportionally, preferably linearly proportionally, with the common voltage VCE. Alternatively the storage driver 580 may be a driver separate from controller 515. In this case the connection between the common terminal 102 driver 570 and the storage driver 580 is superfluous. The controller 515 may be configured to change the storage and common voltages Vst, VCE and control the storage driver 580 such that the storage and common voltage changes correspond.

The proper timing of voltage changes may be achieved in the configuration with a separate storage capacitor line 340, by changing the storage capacitor voltage (e.g., using a storage voltage driver 580) and with a voltage swing proportional to the voltage swing of the common terminal 102. The voltage VEink across the pixel CDE will keep substantially the same value when both the storage capacitor line 340 and the common terminal 102 are switched.

The controller 515 may be any type of controller and/or processor which is configured to perform operation acts in accordance with the present systems, displays and methods, such as to control the various voltage supply sources and/or drivers 520, 530, 570 to drive the display 500 with pulses having different voltage levels and timing. Memory 517 and lookup table 516 may be part of or operationally coupled to the controller/processor 515. The lookup table 516 may be a separate or stored in the memory 517.

The memory 517 and lookup table 516 may be any suitable type of memory where data are stored, (e.g., RAM, ROM, removable memory, CD-ROM, hard drives, DVD, floppy disks or memory cards) or may be a transmission medium or accessible through a network (e.g., a network comprising fiber-optics, the world-wide web, cables, or a wireless channel using time-division multiple access, code-division multiple access, or other radio-frequency channel). Any medium known or developed that can store and/or transmit information suitable for use with a computer system may be used as the computer-readable medium and/or memory. The memory may also store application data as well as other desired data accessible by the controller/processor 515 for configuring it to perform operation acts in accordance with the present systems, displays, and methods.

Additional memories may also be used. The computer-readable medium 516 or 517 and/or any other memories may be long-term, short-term, or a combination of long-term and short-term memories. These memories configure the processor 515 to implement the methods, operational acts, and functions disclosed herein. The memories may be distributed or local and the processor 515, where additional processors may be provided, may also be distributed or may be singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network is still within the memory 517, for instance, because the processor 515 may retrieve the information from the network for operation in accordance with the present system.

The processor 515 is capable of providing control signals to control the voltage supply sources and/or drivers 520, 530, 570, 580 to drive the display 500, and/or performing operations in accordance with the various addressing drive schemes to be described. The processor 515 may be an application-specific or general-use integrated circuit(s). Further, the processor 515 may be a dedicated processor for performing in accordance with the present system or may be a general-purpose processor wherein only one of many functions operates for performing in accordance with the present system. The processor 515 may operate utilizing a program portion, multiple program segments, or may be a hardware device, such as a decoder, demodulator, or a renderer such as TV, DVD player/recorder, personal digital assistant (PDA), mobile phone, etc, utilizing a dedicated or multi-purpose integrated circuit(s).

Any type of processor may be used such as dedicated or shared one. The processor may include micro-processors, central processing units (CPUs), digital signal processors (DSPs), ASICs, or any other processor(s) or controller(s) such as digital optical devices, or analog electrical circuits that perform the same functions, and employ electronic techniques and architecture. The processor is typically under software control for example, and has or communicates with memory that stores the software and other data such as user preferences.

Clearly the controller/processor 515, the memory 517, the lookup table 516, and the display 500 may all or partly be a portion of single (fully or partially) integrated unit such as any device having a display, such as flexible, rollable, and wrapable display devices, telephones, electrophoretic displays, other devices with displays including a PDA, a television, computer system, or other electronic devices. Further, instead of being integrated in a single device, the processor may be distributed between one electronic device or housing and an attachable display device having a matrix of pixel cells 500. In particular, memory 517 may function as a storage medium for storing the lookup table (LUT) 516.

Figure 6:
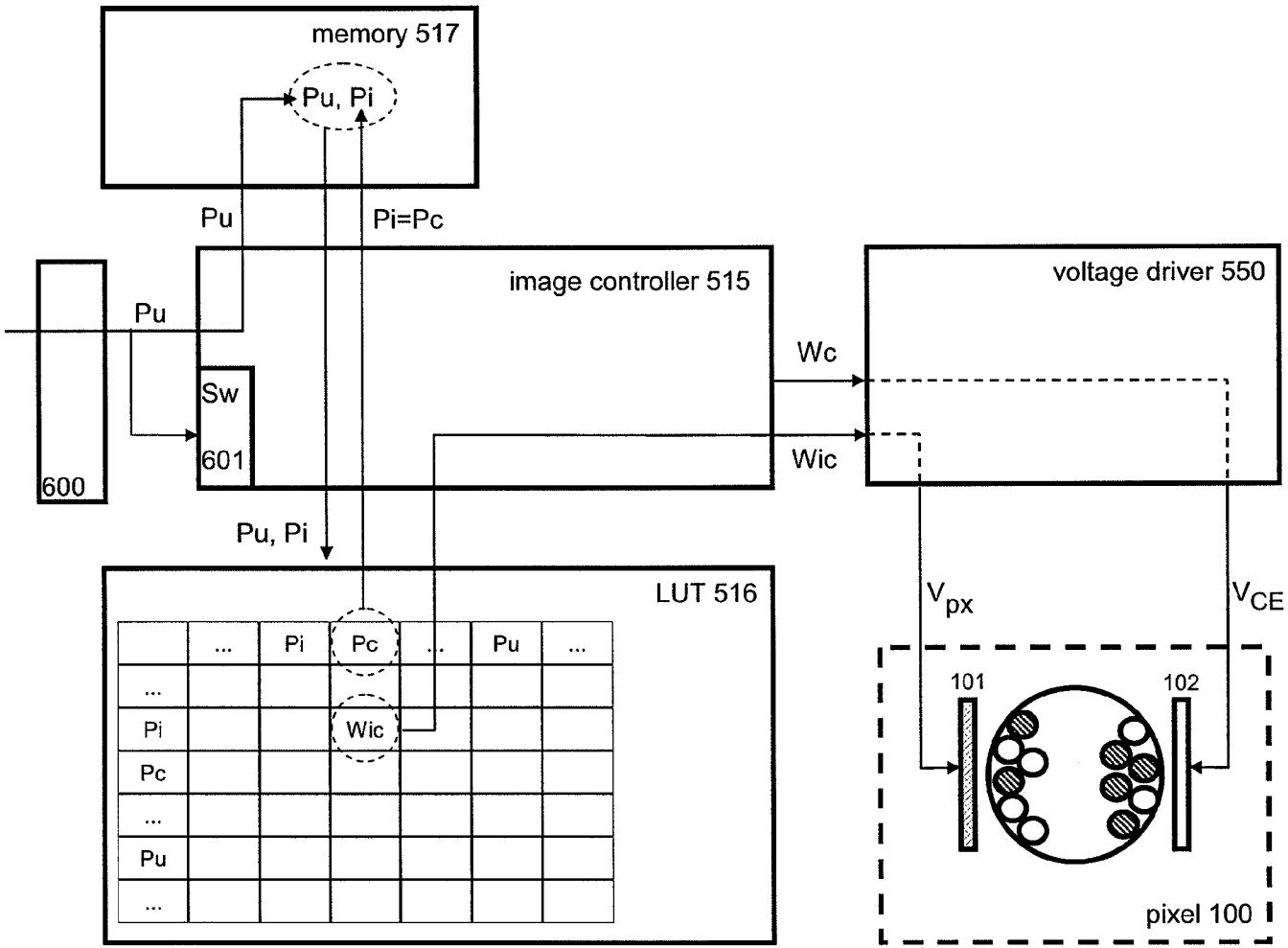
FIG. 6 shows a schematic diagram of signals in a simplified circuit for driving a pixel according to an embodiment.

FIG. 6 is a schematic diagram depicting signals for driving a pixel from an initial state to an update state in a consecutive drive phase according to an embodiment. As discussed above, the image controller 515 accesses memory 517 and lookup table (LUT) 516 which are shown separately in FIG. 6. The LUT 516 is used for storing voltage waveform specifications (e.g., a sequence of time-dependent voltages) that are applied to the pixel and/or common terminals across the pixel to drive the pixel from one discrete pixel state to another discrete pixel state.

The discrete pixel states have a pixel state ordering that is equidistant in a dynamic range as perceived by a human eye with increasing reflectivity of the pixel states (e.g., from black to white). Within this ordered set, a path between two discrete pixel states may traverse one or more pixel states, within the pixel update, from the initial pixel state to the update pixel state.

In the shown embodiment of FIG. 6 the memory 517 stores an update state Pu and an initial state Pi. The update state Pu corresponds to the desired state that the pixel should go to as received by the controller 515. The update state Pu may be received by the controller at any time, during or between update periods. The initial state Pi corresponds to the pixel state of the pixel at the beginning of an update period. The initial state is stored as the resulting pixel state of a previous update period. Preferably the image controller 515 keeps track of the pixel state history of a previous state of the pixel to execute a pixel update.

Waveforms for driving the pixel from a discrete number of initial states to a discrete number of destination states are stored in the LUT 516. In FIGS. 6 (and 14) the LUT is represented by a matrix of waveforms to be supplied by the voltage driver 550 for driving the pixel 100 such that a pixel is driven from an initial state to a discrete number of destination states along a path according to the current mode or phase of the controller. An input interface 600, in particular a user interface 600, transmits an update state Pu to be displayed. The user interface 600 may be arranged to switch the image controller to the consecutive drive phase if the image controller 515 is operating in a conventional direct update drive mode.

In the shown embodiment of FIG. 6, operational modes or drive phases of the image controller may be switched by a switch Sw 601 that may analyze the update image. For example, the image controller 515 comprises image processing circuitry 601 arranged to switch the image controller 515 to the consecutive drive phase, to update at least an area of pixels, said area being designated by the presence of a motion effect in the update image Pu detected by the image processing circuitry.

The switch 601 may designate the mode and/or phase by which the controller controls the voltage driver for driving one or more pixels according to that mode and/or phase. In the current illustrative example of the signals (FIG. 6), the image controller 515 is in a 'consecutive drive phase', according to an aspect of the invention.

In the consecutive drive phase, during a pixel update, the image controller 515 repeatedly executes, as long as initial and update pixel states are different, the steps of:

retrieving initial pixel state Pi and update pixel state Pu, matching from the set of waveforms in the lookup table 516, a wave form W and a corresponding consecutive pixel state, storing the consecutive pixel state Pc in the memory as a new initial state; and controlling the voltage driver 550 to drive the pixel 100 from the initial state Pi to the consecutive state Pc by supplying said consecutive waveform to the pixel during a consecutive update period so as to provide a consecutive update period smaller than the pixel update period.

Accordingly, the controller 515 drives the pixel through one or more consecutive states on a path between the initial state and the update state. A waveform Wic is applied by the controller 515 to the voltage driver 550 optionally in combination with a common driving waveform We to drive the pixel from the initial state Pi to a consecutive state Pc within a desired update time and according to the current mode (e.g. a direct or quality drive mode). The waveforms are interpreted by the voltage driver 550 which supplies corresponding voltage waveforms Vpx and VCE to the pixel and common terminals, respectively.

Figure 7:
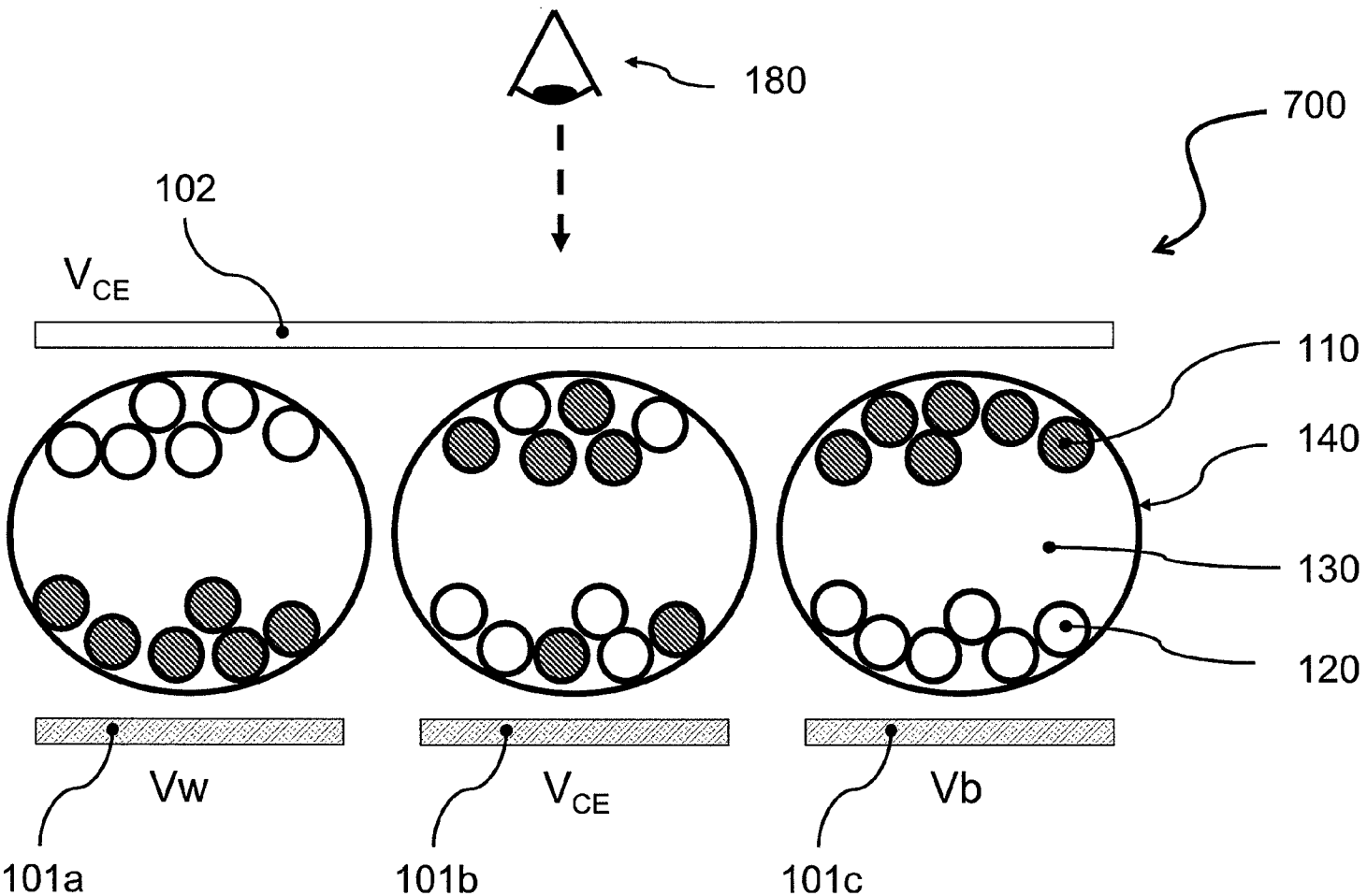
FIG. 7 shows a plurality of electrophoretic pixels and terminals according to an embodiment.

Controller 515 stores the consecutive state Pc as a new initial state Pi in the memory 517 before or at the end of the consecutive update period. At the start of the next update period, a comparison is made again between the initial state and the steps described above may be repeated. Meanwhile, advantageously, the update state Pu may be modified at any time during a consecutive update period. The new update state will then be used for the next upcoming update period, and a corresponding path and/or consecutive states may be selected by the controller based on the modified update state FIG. 7 shows a plurality of pixels 700 where different voltages are applied to the pixel terminals. For all pixels a common voltage VCE is applied via common driver 570 (see FIG. 5) to the common terminal 102. In the left pixel a voltage Vw is applied to pixel terminal 101*a* for driving the pixel to white (TW). In the current example with negatively charged white particles and positively charged black particles, Vw should be a lower voltage than VCE (Vw<VCE) for creating an electric field in the pixel that drives the black particles towards the pixel electrode and the white particles towards the common electrode which is on the side of the viewer 180. Similarly for the right pixel where Vb>VCE is applied to the pixel terminal 101*c*, the pixel is driven to black (TB). In the middle pixel a voltage is applied to the pixel terminal 101*b* that is equal to the common driving voltage VCE. This results in the fact that this pixel is not driven but holds its current pixel state P, which in this case means that it remains grey.

Figure 8:
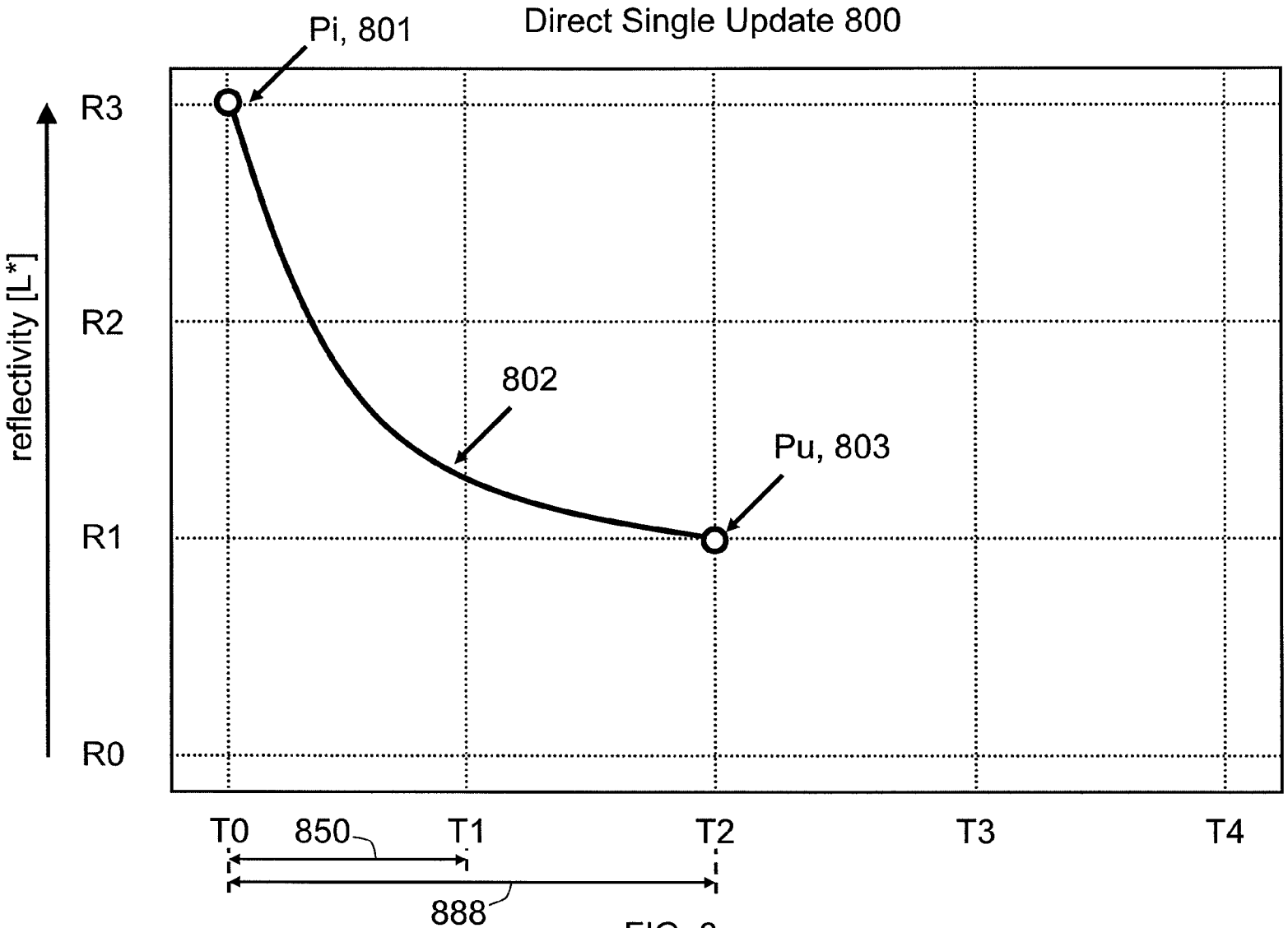
FIG. 8 shows a schematic graph of a time dependent reflectivity trajectory of a conventional direct update.

In a conventional grey scale display it is advantageous that the pixels be able to attain a set of states that is equidistant in luminance or perceived brightness (under normal lighting conditions, e.g. daylight). In the case of an electrophoretic display where images are perceived by a user after light is reflected off the display, this means that the difference between steps on the grey ladder are equal in the luminous intensity reflected off the pixel factored by the sensitivity curve for the human eye, e.g. equal steps in candela per square meter, denoted here by the reflectivity [L*]. Thus, in a conventional grey scale display where the pixels can attain a discrete set of grey scales, these discrete grey scales are conventionally chosen such that they span the grey scale space in equidistant steps as perceived by a user of that display. Of course the same may apply for color displays, where the distance between perceived colors is equidistant to span the color space based on a user perception of that color space. The choice of setting the position of the grey levels is particularly important if the display is bound by a limited number of grey scales FIG. 8 shows a schematic graph of a time dependent reflectivity trajectory of a conventional pixel update 800. In a conventional pixel update 800, hereinafter called single pixel update drive phase to distinguish it from the consecutive drive phase discussed with respect to FIG. 6, the pixel update period 888 involves retrieving the initial state Pi and update state Pu from the memory, and retrieving a single pixel update waveform from the lookup table that when applied, causes the transition from the initial state Pi to the update state Pu. The voltage driver 550 drives the pixel from the initial state to the update state using the retrieved single waveform.

In the transition example depicted in FIG. 8, the single pixel update drive phase (SUDP) is executed in a direct update drive mode (DUDM). In DUDM a pixel is driven directly to the update mode, i.e. via a direct path between the initial state and update state that changes monotonically in reflection [L*] (so not back and forth). In the example illustratively depicted in FIG. 8, the pixel is driven during an update period 888 from an initial state 801 through a path 802 that monotonically changes to reach an update state 803. The pixel state/reflectivity of the initial and update states in this case are R3 and R1, respectively. The actual update period in this example takes a fixed number of frames 850 (T0-T1 and T1-T2). In principle, an update period may take any number of frames but it may be practical to synchronize the update periods of different pixels by using fixed numbers of frame periods (e.g., in synch with a common driving heart beat period which defines a maximum pixel update period). For example, for a transition between other pixel states, a pixel update period might take four sub periods of a fixed number of frames (T0-T4).

In the current example of FIG. 8, the LUT may comprise waveforms for driving the pixel between any of the equidistant reflectivity states R0, R1, R2, and R3. These states may be designated as possible update states.

Figure 9:
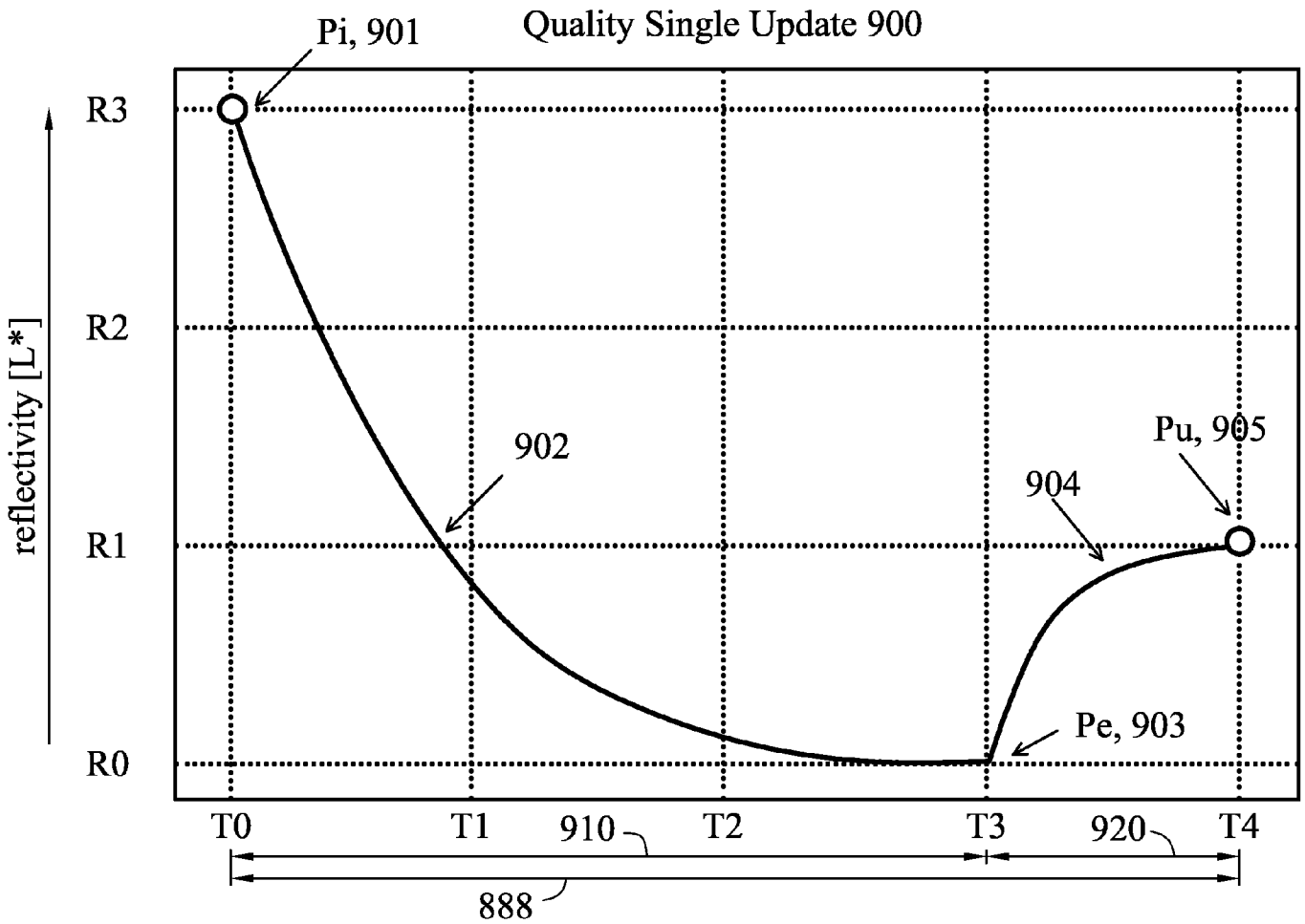
FIG. 9 ( PRIOR ART )
FIG. 9 shows a schematic graph of a time dependent reflectivity trajectory of a conventional quality update.

Alternatively to the direct update disclosed in FIG. 8, FIG. 9 shows a schematic graph of a time dependent reflectivity trajectory of a quality single pixel update 900 as conventionally carried out. In such a drive mode, the controller 515 controls the voltage driver 550 to update the pixels, with each path having an intermediate extreme pixel state. In this embodiment, the extreme pixel state 903 is depicted as R0 to reset a pixel state. Other intermediate extreme pixel states, different from a predefined update state, may be used. The update path is programmed in the controller 515 according to a desired drive mode.

In FIG. 8, the extreme pixel state is identified as R0, i.e. the black state. The quality drive mode is preferably used to reduce an involuntary spread and/or uncertainty of the grey scales of the pixels that may occur due to the bistable nature of the electrophoretic display medium and the resulting build-up of image history. To correct for this uncertainty and to arrive in a specific and known pixel state 905 the pixel may be driven in an update period 888 that comprises a reset phase 910 and a tune phase 920. In the reset phase 910 the involuntary spread is reduced, for example, by driving the pixel against the rails of one of the extreme pixel states Pe (black or white), i.e., a pixel state wherein the pixel attains a minimum or maximum reflectivity. In the tune phase 920 the pixel is driven from the well-defined and specific extreme pixel state to the desired update state 905.

In the current example, the pixel is driven from an initial state 901 through a path 902, 904 via an extreme pixel state 903 to the update state 905. The update state may be equal to the initial state, if it is desired not to change the state of the pixel, but reduce the spread/uncertainty of the greyscale. In the current example, the single pixel update period takes four frames. In another embodiment this update period may take another number of frames.

Figure 10:
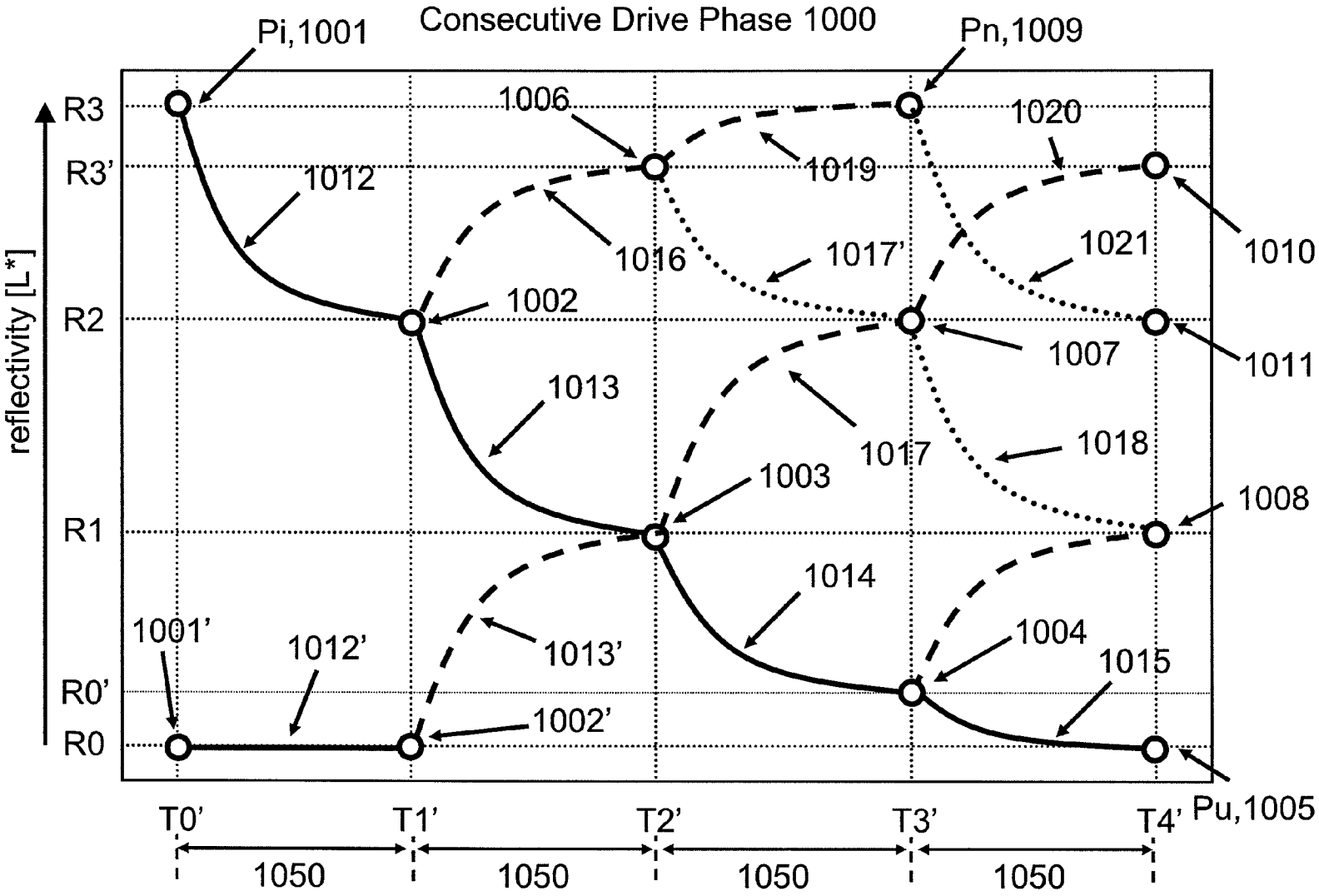
FIG. 10 shows a schematic graph of time dependent reflectivity trajectories according to an embodiment.

FIG. 10 shows an embodiment according to a consecutive drive phase 1000 executed by the controller 515. Specifically, a schematic graph of time dependent reflectivity trajectories is shown, wherein a pixel is updated from an initial pixel state Pi through a path of one or more consecutive updates. Alternatively, in the consecutive drive phase, each path of consecutive states 1002, 1004 monotonically changes according to the pixel state ordering so as to minimize the display response time, or each path has an extreme pixel state according to the reset a pixel state, analogous to the quality drive mode illustrated in FIG. 9.

In the following consecutive driving is explained for a number of grey states N equal to 4 and four consecutive update periods. The number of consecutive periods 1050 is a maximum number of sub-updates that are needed to switch from the most extreme white state to the most extreme black state or vice versa. It will be understood that the principle can apply for any value of N grey states and for any chosen sub-update frequency. It will also be understood that the same principle will apply to a color display, where variable shades of certain colors are used together to create a color image.

Each consecutive update period 1050 may comprise several frames wherein a pixel is driven to a next consecutive state on the path between the initial state and the update state. The next consecutive state on the path should be reachable within the consecutive update period 1050. In a single pixel update driving phase where there are no sub-update periods (only full update periods) the update period is determined by the slowest transition, usually the time it takes to go from one extreme pixel state to another. In a consecutive driving phase the update period can be shorter because the trajectory can be cut into pieces.

For illustrative purposes, in the shown embodiment, the 4 grey states/update states are called R0, R1, R2, R3, with for example R0 being the most extreme black state and R3 being the most extreme white state. The consecutive direct update consists of consecutive update periods 1050 of a certain fixed duration. For instance, for E Ink (at 15V, at room temperature) a consecutive update period with duration 60 ms-200 ms would be preferred. This would allow a direct update R0-R3 (full swing) in 4 consecutive updates.

In a consecutive driving phase the image controller 515 receives the task to update pixels from the initial state to a received update state. The controller 515 is programmed to match a best sub-transition of consecutive sub-updates, based on a predefined path of transitions that is dependent on the drive mode.

This may include, in the consecutive drive phase, updating a pixel to a consecutive pixel state that is adjacent to the initial state. Alternatively, defining a path of consecutive pixel states from an initial pixel state to the update pixel state may include setting a desired update period for a pixel update having a pixel update period such that a consecutive update period to the consecutive state is lower than the pixel update period.

In the example of FIG. 10, having an initial pixel state R3 for pixel Pi and an intended update state Pu being R0, the first consecutive update may be a transition from R3 (1001) to R2 (1002) through path 1012. In the illustrated example, if the controller 515 receives, during a consecutive update period, a new update state Pn 1009, the controller 515 may timely switch (e.g., before initiation of a next consecutive period) to go to that new update state 1009 via path 1016 and 1019 and not continue the path 1013 in accordance with previous pixel update state 1005.

In an embodiment, it may be required to introduce intermediate grey states as indicated in the figures with states R3' and R0'. Because the transitions towards the extreme pixel states R1-R0 and R2-R3 are typically the slowest transitions, it may be impossible to realize these transitions in one period 1050. In that case it is necessary to define intermediate non-equidistant levels, to have an intermediate pixel state adjacent an extreme pixel state in between R2 and R3, such as R3', and in between R1 and R0, such as R0'. A full direct consecutive update R3-R0 can consist of the 4 sub-updates R3-R2, R2-R1, R1-R0', and R0'-R0. It is noted that the intermediate states R0' and R3' are not used here as update states (i.e., destination states), but added in the path to reach a known and specific consecutive state within a desired (sub)update period. The minimum set of (sub-) transitions that should be possible in one sub-update are: R3-R2, R3'-R2, R2-R1, R1-R0', R0'-R0, R0-R1, R0'-R1, R1-R2, R2-R3', R3'-R3 (the null transitions R0-R0, R1-R1, R2-R2, R3-R3 do not require time in a direct update).

While the controller is driving the pixel state from R2 to R3, it reaches R3' as an intermediate consecutive state. If it is desired, the controller 515 does not need to finish this update, but may go from R3' (1006) back to R2 (1007 via 1017'). From there the controller 515 can drive the pixel to R3 via R3' (path 1020 to 1010), or drive the pixel to R1 (1008) via path 1018 or hold the current pixel state (null transition R2-R2, not shown).

In another example shown in FIG. 10, initial pixel state 1001' is held initially in the first update period T0'-T1' (i.e. the pixel state is not changed in a path 1012' to state 1002). Subsequently the pixel is driven to 1003 with reflectivity R1 through path 1013'. From there the controller may hold the state (not shown) or select an adjacent pixel state by driving the pixel to R2 via path 1017 or drive the pixel back to an update state 1005 with reflectivity R0 via 1004 with reflectivity R0' using path 1014, 1015.

Thus at any consecutive state, the controller can be switched to drive the pixel to a new update state via consecutive states. In the current example it is shown that a consecutive state is not necessarily an adjacent state in an ordered set of pixel states according to a reflectivity or grey scale of the pixel. For example the path 1021 from 1009 to 1011 skips the R3' state because the transition R3-R2 in this example is fast enough to finish within a consecutive update period 1050.

In another example (not shown) an update from R0 to R3 may have an update path R0-R1-R2-R3. Thus in this example no extra non-equidistant grey states have been added. This example has an update frequency of 3, i.e. the display can switch between any two pixel states in a maximum of three sub updates, i.e. two intermediate consecutive steps. As noted above, not all updates necessarily take the same time (e.g., the R2-R3 transition may take longer, due to characteristics of electrophoretic driving). However, it is advantageous to keep a global timing for the update periods of the display, for example, because an alternating common voltage has a certain frequency. Therefore the update period is typically the same period for all updates and is limited by the slowest update. When a faster update is finished before the end of an update period, the voltage waveform may be adjusted during some frames of the update period, for example, to hold the pixel state, and/or to lower the driving voltage.

Thus, if it is desired to decrease an update period, it may be necessary to introduce intermediate non-equidistant grey-scale pixel states between the regular update states and increase the update frequency. It is noted that even if the update frequency is 2, and thus a single intermediate consecutive state is used on a path between two extreme pixel states, the update period for all transitions of the display may lower substantially, because it is no longer limited by this slowest transition. Thus, an advantage is already achieved when a single intermediate consecutive state is used that is not the destination update state.

From the above it should also be noted again that the a consecutive state Pc is not necessarily an adjacent state but may be any state on a path between an initial state Pi and an update state Pu that serves to lower an update period.

A consecutive update phase may also be combined with a quality drive mode, such as described for the single pixel update in FIG. 9. In a quality drive mode the reset phase 910 depends on the current grey state and the tune phase 920 depends on the destination grey state. The principle of consecutive driving can also be applied to quality driving. By way of example, if the destination grey state changes before the start of the tune phase 920, the quality drive mode can be redirected to the new destination grey state, without finishing the quality drive mode initially planned.

Likewise, the quality drive mode may be cancelled in the reset phase and be redirected from a consecutive state to a new update state. The quality drive mode that was meant to reduce a spread of the grey scales is thus postponed and may be executed at a later, more convenient, time.

Figure 11:
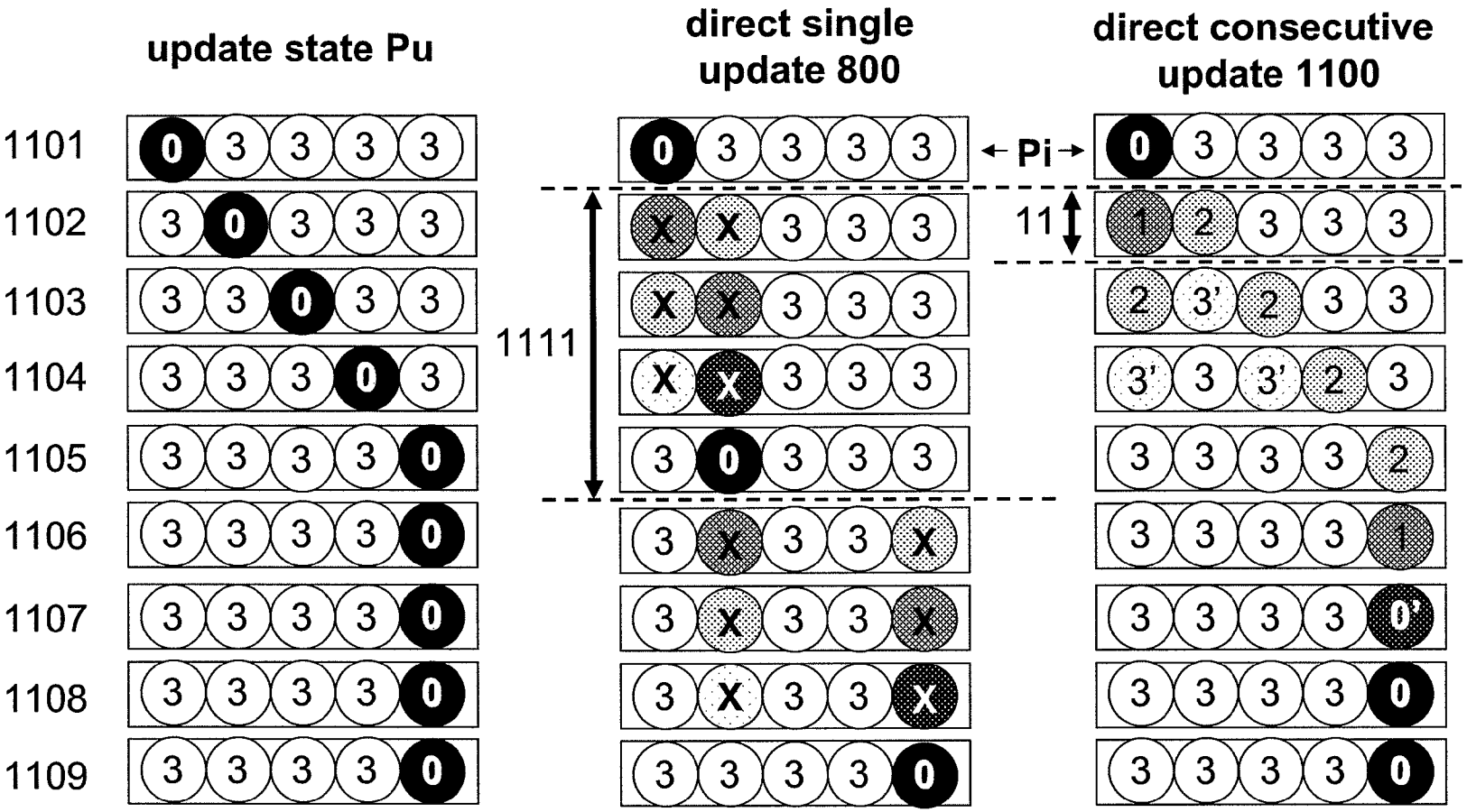
FIG. 11 shows a schematic comparison between direct update and consecutive update for a moving black pixel according to an embodiment.

FIG. 11 shows a schematic comparison between single pixel update and consecutive update for a moving black pixel according to an embodiment in a direct driving mode. An advantage of a consecutive state is that it can lower an update period and therewith may also lower a response time of the display (i.e., the time it takes the display to respond to changes in the update state of one or more of the pixels). This is illustrated in FIG. 11 by comparing the response of a direct single pixel update 800 in a conventional single pixel update drive phase and the direct consecutive update 1100 in a consecutive drive phase 1000 with an update state Pu that is changed at the start of the (sub)update period. In this embodiment, a user interface receives user input to be displayed and the user interface switches the image controller 515 to the consecutive drive phase at the beginning of the receiving interval. In the consecutive drive phase, at the beginning of each new consecutive update period an update state may be changed to a modified update state, as received from for instance the user interface, at any time during the consecutive update period, wherein a new consecutive state is matched corresponding to the modified update state. That is, a transition from an initial state to an update state need not be completed, but during intermediate consecutive updates the final update state can be changed.

Accordingly, in the example illustratively depicted in FIG. 11, the update state changes for each new period 1101-1105. The possible pixel states are designated from black to white 0, 0', 1, 2, 3', 3, wherein 0, 1, 2, 3 form an ordered set of possible update states with equidistant steps in their perceived reflectivity while the intermediate states 0' and 3' have been added to reduce an update period that was otherwise limited by the transition 1-0 and 2-3, respectively.

At the start of the single pixel update period 1111 and consecutive update period 11, the display in the direct update drive phase receives the update state 3-0-3-3-3, i.e. the black pixel that was in a first position of the initial state 0-3-3-3-3 is shifted to a second position.

In the singe update period 1111, the display responds by driving the appropriate pixels to white and black. During this update period 1111, the pixels are in an unspecified state, represented by a letter X. The fact that the pixel is in an unspecified state X during this period means that the update can not be interrupted to drive the pixel to another state (because this requires a known starting position for electrophoretic displays). Therefore, even though in the sub-update period 1103 the pixel update state has once again changed, the conventional direct update display can not yet respond to this change and first has to finish the single pixel update period 1111. Only when this is done at the start of 1106 can the display accept a new update state. However, because the response was slow, several intermediate update states will not be registered on the direct update display, and only the final update will be registered. Thus it is noted that a direct single pixel update 800 lags behind the desired update state due to the length of the update period and the inability to change the update state midway this period.

On the right side, an example is shown of an embodiment of a consecutive direct update. It is noted that upon the change of the update state in 1102, the consecutive update also starts driving the appropriate pixels to white and black. However, unlike the single drive phase, the consecutive drive phase drives the pixel through a series of specific pixel states 0-1-2-3'-3. This means for the second pixel that is driven from 3 to 2, a new update state in 1103 can be responded to by driving this pixel back to 3 (via 3' in this example). Thus the controller can drive the pixels to the new update states at the beginning of each sub-update period which may be chosen to be as short as desired (although for shorter sub-update periods, more intermediate pixel states/waveforms may need to be introduced in the LUT).

It is observed that the consecutive update in this example follows the update state more closely than the single pixel update. In the consecutive update a grey pixel state 2 follows the update state 0. Once the update state stops changing, the consecutive update can finish an also reach 0 (through sub-updates 1105-1109). It is further observed that the consecutive update reaches this destination update state before the single pixel update state. This has to do with the fact that the final update state was reached while the single pixel update was not yet finished with the previous single pixel update.

Figure 12:
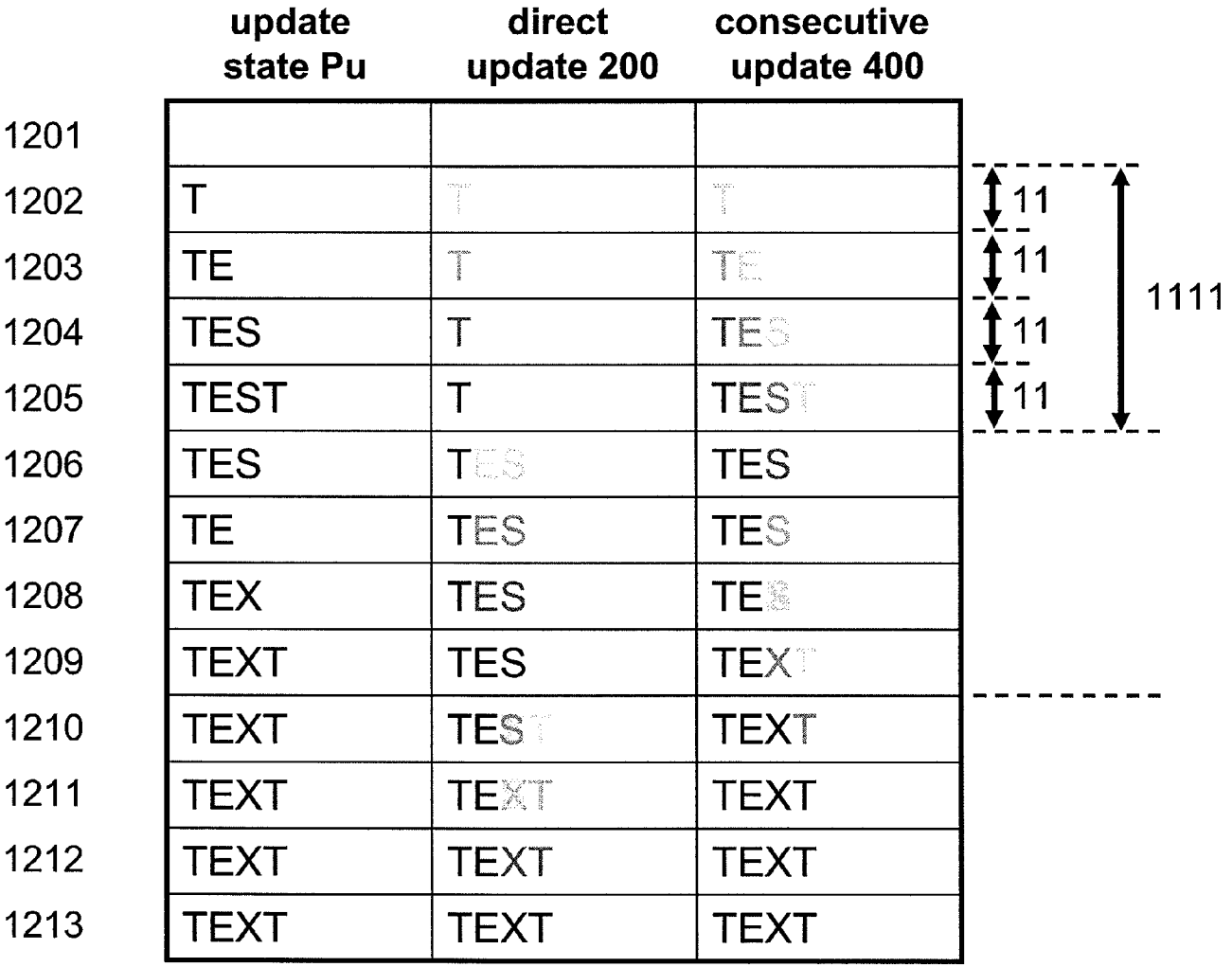
FIG. 12 shows a schematic comparison between direct update and consecutive update for a text console according to an embodiment.

FIG. 12 shows as an alternative illustration, a schematic comparison between direct update and consecutive update during a period 1201-1213 for a text console according to an embodiment. Again an update state for the text to be displayed is shown and compared with the single (direct) update and consecutive (direct) update. In this example a user is typing the word 'TEXT' but makes a mistake and first types TEST before correcting this, for example, by a backspace key an reentering the correct word.

In an advantageous embodiment the display comprises a user interface such as a keyboard or touch panel that switches the controller, for example, with switching signal Sw (see FIG. 6) to a consecutive drive phase at least for those parts of the display that provide the user with feedback from his input. Ideally, this feedback is provided as soon as possible. Thereto the consecutive drive phase may be initiated at the beginning of a receiving interval, i.e. an interval wherein the display is ready to receive input from the user.

In time period 1202 the user enters the letter T. Both the single and consecutive displays respond by having the pixels that form this letter driven to black. Meanwhile the user keeps typing a letter E. The singe update does not respond because it is still updating the first letter in an update period 1111. The consecutive update responds at the beginning of the sub update period 11 in 1203. Meanwhile the user realizes a mistake and starts erasing the letters T and S. In 1206 the direct update responds to the new update state by having the pixels forming the additional letters ES be driven to black (the last letter T was never registered on this display). Unfortunately for the user of the single pixel update display he has to wait an additional update period for the mistakenly typed letter S to be removed. On the other hand the consecutive update display responds at the beginning of each sub-update to a new update state Pu and may therefore provide the user with a more responsive interface.

It is noted that even while the letters on the consecutive display are not yet completely black, the user nonetheless receives feedback from his input by the quick appearance of the 'ingrowing' grey letters. Furthermore, when the user stops typing, the letters will completely turn black providing an improved legibility over, for example, a display that drives pixels only to grey.

In applications where a user interacts with a system such as a display it is advantageous that the system responds to the input of the user within a time frame of approximately 200 ms. If this response time is longer, the user may regard the display as sluggish and may, for example, start reentering instructions to the display because he or she feels that the first instructions were not registered. In the current example, e.g. the user may remove all text by pressing the backspace key multiple times because it was believed that the key did not respond.

In an advantageous embodiment the update period is set to 200 milliseconds or less so that the display has a comfortable response time for a user. This update period may be lowered further below the timescale of the slowest switch to an adjacent state by introducing intermediate states. These intermediate states may be non-equidistant states on a grey scale ladder of pixel states.

In a further advantageous embodiment the consecutive driving phase is slightly altered. Typing usually involves placing black letters on a white background or the opposite, white letters on a black background. Hence the two transitions that take place are R3-R0 and R0-R3. To achieve higher update speeds, the letters drawn on the screen could be made grey instead of black, as this requires a shorter update time. Making a whole text grey is undesirable however, as it significantly reduces the legibility of the text. It would therefore be very convenient to make typing a two-stage process. For instance for typing a black letter on a white background (R3-R0):

1. use two sub-updates to write a dark grey letter (R3-R2, R2-R1)

2. wait until the new letter is typed or a predetermined time-out is reached; then use two sub-updates to go from dark grey to black (R1-R0', R0'-R0), concurrent with step 1 for a new letter if a new letter is typed. A sub-update frequency of 2 could also be advantageous in this case.

Figure 13:
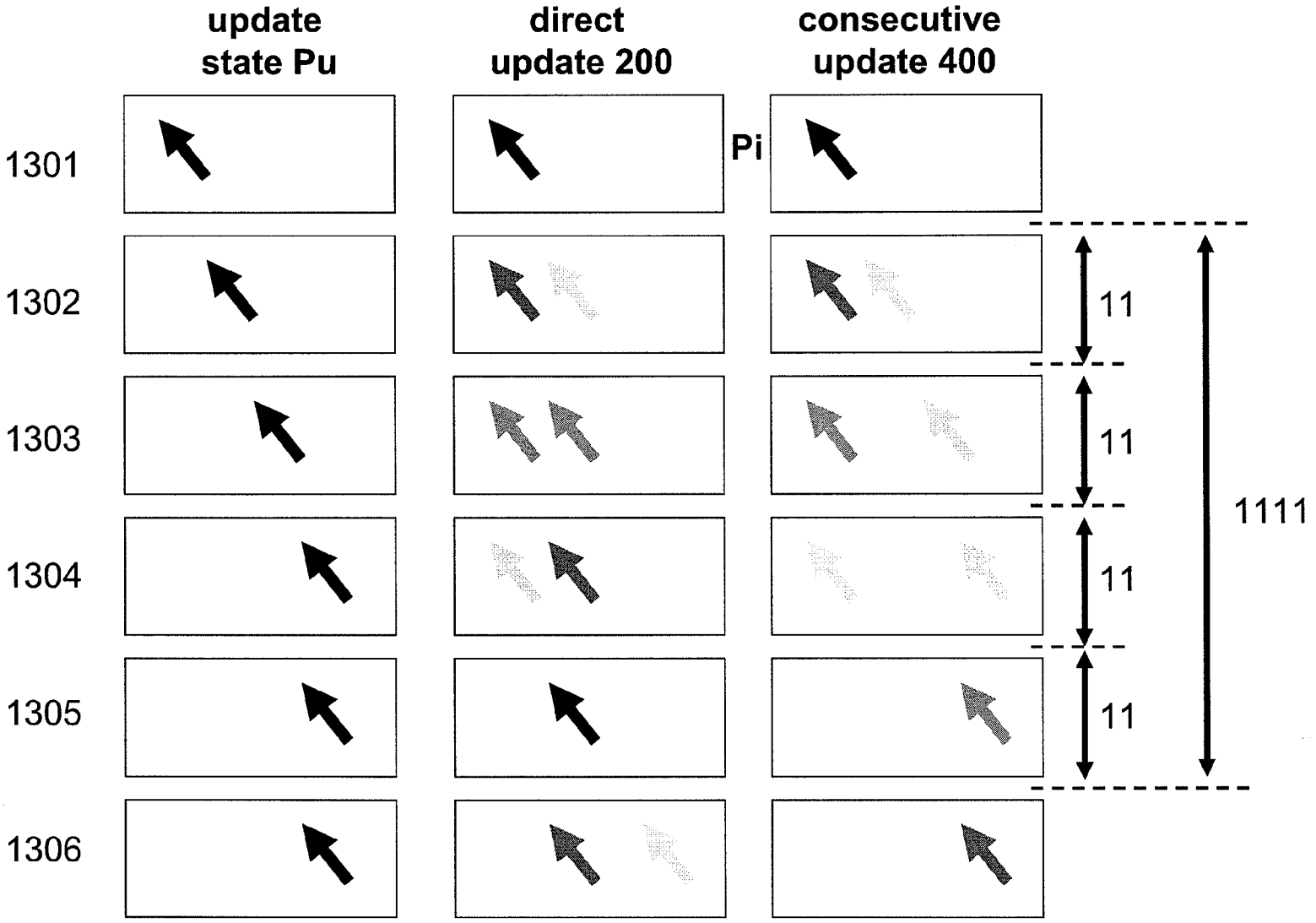
FIG. 13 shows a schematic comparison between direct update and consecutive update for a moving image according to an embodiment.

FIG. 13 shows a schematic comparison between direct update and consecutive update methods for a moving image according to an embodiment.

Cursor motion and movement in document lists, etcetera, is an example of where consecutive driving can improve the user interface. The end user is used to smooth and fast scrolling through lists or other means to select actions on many of his/her devices. Typical usage scenarios require a system response time of 100 to 200 milliseconds. This is a time zone where the user feels that actions have a direct effect. Longer response times cause users to repeat actions, as they mistakenly assume that the system has not registered the action. Fast response is thus advantageous and consecutive driving can provide this.

In an advantageous embodiment the display comprises image processing circuitry that detects the presence of a motion effect. The image processing circuitry may designate at least part of the display for consecutive driving, for example, using the switch signal Sw (see, e.g., FIG. 6) to switch the image controller to a consecutive drive phase for the designated part of the display when a motion effect is detected. Alternatively, this motion effect detection could be part of software that analyses the presence of motion effects.

As a further illustrative example, FIG. 13 shows an arrow display as is commonly used to indicate the position of a (mouse) pointer/cursor moved to the right as indicated by the update states 1301-1306. It is noted that while the display with single pixel update driving first has to finish the first received update state 1302 in an update period 1111, the consecutive driving mode follows the desired update image more closely by redirecting the update to a new update state when it is available at the beginning of each sub-update or consecutive update period 11.

An advantage for a user seeing the feedback from the grey moving arrow (consecutive driving) is that he can interpret and steer the position more accurately than an arrow that first fully updates the display with a first update state before starting with a next update state (single pixel update phase).

In an advantageous embodiment all sub-updates are handled automatically by the image controller in a consecutive drive phase. The consecutive drive phase has advantages for all instances where a display image is frequently updated. This means that not only user feedback is improved, but all kinds of animation on the display. In the shown embodiments, the movement of a black image will be shown as a moving grey version of that image until the movement stops, after which the image will keep darkening until it reaches a steady update state.

For animated sequences the perception of movement is typically more important than the visual quality of the moving object. Consecutive direct updating may provide this. In creating forms of animation, the perceived speed of a display can also be further enhanced by concurrent driving in adjacent rectangles or even adjacent pixels. Consecutive driving effectively includes concurrent driving in that it allows starting concurrent updates at the start of each sub-update. However, the perceived quality of the animation will greatly benefit from not having to finish each transition. There will be less annoying after-images or "delayed motion."

Figure 14:
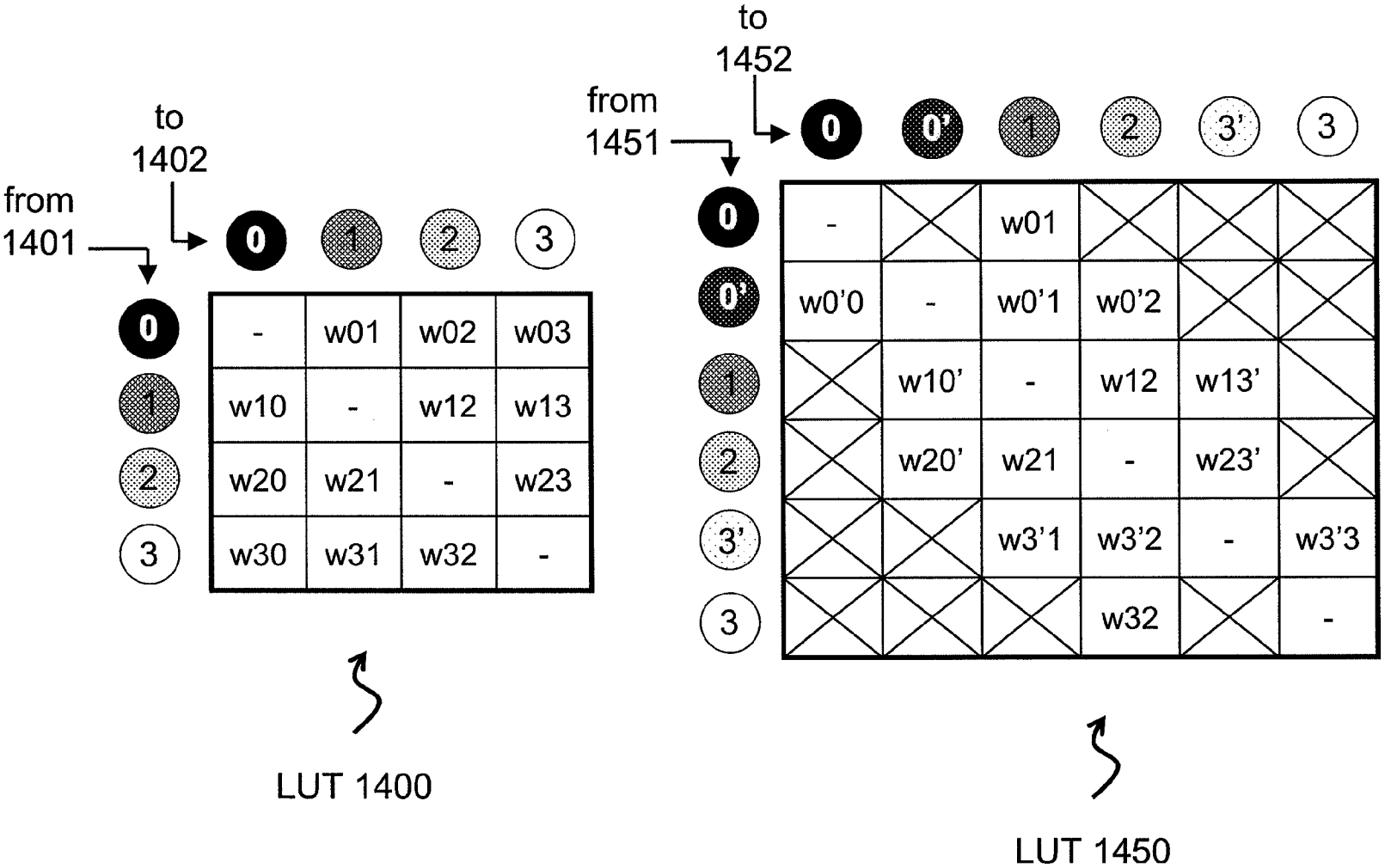
FIG. 14 shows a schematic comparison between lookup tables for direct update and consecutive update according to an embodiment.

FIG. 14 shows a schematic comparison between lookup tables (LUT) for single pixel update and consecutive update driving phases for a direct update, according to an embodiment.

The LUT 1400 for the single pixel update drive phase contains single waveforms for driving a pixel from initial pixel states 1401 (0,1,2,3) to any other pixel state 1402 (0,1, 2,3) using that single waveform. By way of example, the waveform w03 describes how to drive the pixel from state 0 to 3. The single waveform transition means that the pixel state during the transition is not specified or known, i.e. it can not be used as a starting point. This means that the single waveform transition must be finished before a next update may be initiated The waveforms may comprise in a pulse width modulation mode, by way of example, parameters that indicate a sequence of discrete voltages −7.5, 0, 7.5V that are applied in different frames of an update period. In another embodiment, the waveform may specify the amplitude of a voltage that is applied during a part of or a whole update period. In yet another embodiment, the waveform may comprise an arbitrary pulse width and/or amplitude modulated voltage that drives the pixels to an update state.

The LUT 1450 for the consecutive update drive phase contains waveforms for consecutive transitions, by way of example those transitions that can be reached within a predetermined (sub) update or consecutive period 11. As shown in the consecutive driving LUT 1450, the LUT may also comprise waveforms for transitions that go beyond an adjacent pixel state (e.g., w0'2 for a transition from 0' to 2). The criterion is that the waveform can drive the pixel from the initial state 1451 to the next consecutive state 1452, within the constraints of the display's update period and/or voltage limitations. Besides a lowering of the update period, it may also be advantageous to lower the voltages. To still maintain acceptable response times, consecutive driving can be used.

Differences that may be noted between a conventional LUT 1400 comprising single pixel update waveforms and a 'consecutive' LUT 1450 for consecutive driving are:

1. The waveforms in a LUT 1450 used for consecutive driving do not comprise waveforms for transitions that exceed the sub-update period. In practice this means that (unlike the LUT 1400) the LUT 1450 contains few waveforms for transitions to or from extreme pixel states since these transitions typically take the longest update time (or at least these waveforms are not used in the consecutive drive phase). The reason for this can be understood as follows: if a waveform for the longest transition between extreme pixel states (e.g. black to white) could be used, there would be little need for using consecutive driving because all transitions could be handled within the update period.
2. In an advantageous embodiment, the LUT 1450 used for consecutive driving may comprise additional waveforms for transitions to intermediate pixel states that have a non-equidistant perceived reflectivity step from the other pixel states. In other words the waveforms for driving the pixels to potential update states Pu form a subset of the set of waveforms. The reason for this can be understood as follows: in a conventional LUT the possible update pixel states are chosen such that they form a ladder of grey scales with equidistant steps in perceived reflectivity or luminance; in addition to these equidistant pixel states the consecutive LUT 1450 may comprise additional waveforms for driving the pixels to intermediate states that are chosen not on the basis of their reflectivity but on the requirement that they can be reached within the (sub)update period.
3. In a further embodiment, a subset of the aforementioned additional waveforms (e.g. w10', w23') in the LUT 1450 may drive the pixel to a pixel state (e.g. 0' and 3') that no other waveform (used in the LUT 1450) will reach. Otherwise stated, not all transitions in the LUT are symmetric (waveforms for transitions back and forth between pixel states). This can be understood as follows: because the intermediate grey levels are not necessarily update states themselves, there may be no need to drive a pixel to that state except on a specific path, such as for example driving the pixel from 2 to 3 via the intermediate consecutive state 3' uses waveform w23'; the reverse transition 3 to 2 may be quick enough to be driven with a consecutive waveform w32, so the intermediate state 3' is not a consecutive state when driving 'from the other side'.

Figure 15:
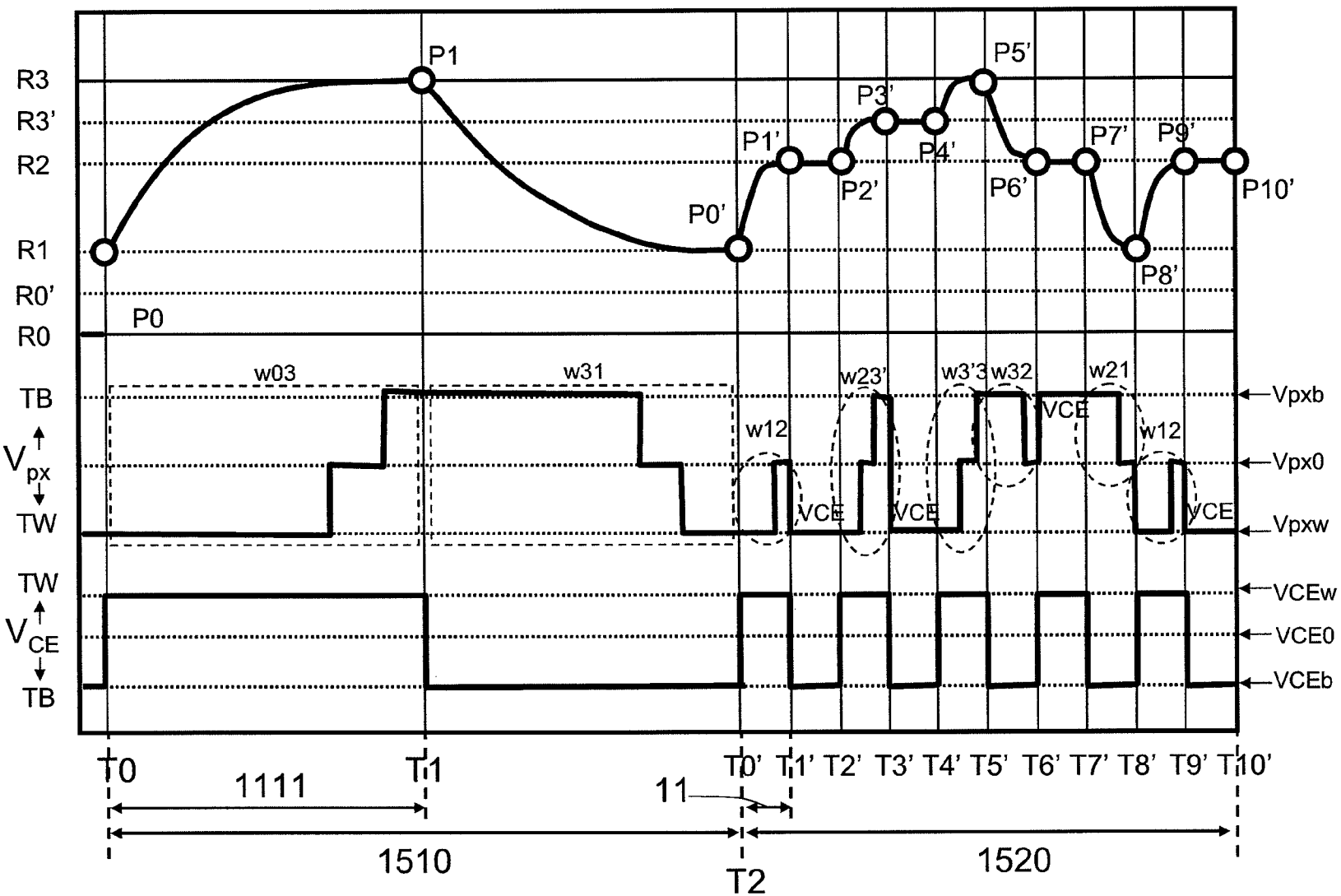
FIG. 15 shows a schematic graph of time-dependent driving voltages and reflectivity according to an embodiment.

FIG. 15 shows a schematic graph of time-dependent driving voltages and reflectivity according to an embodiment. In the shown figure the controller switches at T0' from direct single waveform driving during a period 1510 to direct consecutive driving during a period 1520.

Electrophoretic displays are relatively slow and generally speaking respond to the average pixel voltage during a frame time. This response to the integral in time of the pixel voltage, implies that there are different types of row-to-row addressing for electrophoretic displays: e.g. amplitude modulation driving (grey scales are rendered by modulating the data voltage on the columns) and pulse width modulation (grey scales are rendered by modulating the number of frame times that a certain set voltage is applied).

FIG. 15 shows a schematic set of voltage traces for pulse width modulation. The voltage waveform Vpx on the pixel electrode 101 comprises a sequence of pulses with voltages Vpxb, Vpx0, Vpx (e,g, +7.5V, 0V, −7.5V). These pulses are typically applied by column driver 530 (See FIG. 5) in synch with an alternating common drive voltage VCE applied by common electrode driver 570 to the common terminal 102. A storage voltage driver 580 may operate in correspondence with the common driver 570. In effect, alternatingly, a to white VCE phase and a to black VCEb phase are provided by modulating the Common Voltage between plural voltages VCEw, and VCEb, in particular, (e.g., between +7.5V, −7.5V). This results in a driving voltage VEink=VCE−Vpx that drives the pixel through a sequence of pixel states P0, P1, P0'-P10'.

The voltages may thus be time dependent waveforms which may depend on the phase and/or mode of the display and/or pixel. For example, in a low voltage driving mode (LVD) as shown, the voltages Vpx can be lowered in an absolute sense by applying a modulating common voltage VCE that may take, for example, the form of a block waveform with alternating polarity (as shown in FIG. 15). In alternating update periods, by way of example, the common voltage VCE can be +7.5V and −7.5V.

In the first update period 1111 (T0-T1), VCE=+7.5V and the pixel can be driven to white (TW), e.g. when Vpx=−7.5 (VEink=+15V) or alternatively, the pixel can maintain its current state, when Vpx=VCE=+7.5V (VEink=0V). Furthermore the pixel voltage Vpx may be held at 0V during one or more frames of the period 1510 to reduce the driving voltage and provide slow driving TW (VEink=+7.5V). A voltage waveform in the example shown in FIG. 15 may thus comprise a sequence of discrete pixel voltages Vpx=Vpxw,Vpx0, Vpxb, in a predetermined number of frames (e.g. described in the LUT) tuned such that the pixel ends up in a known and specific the pixel state.

In a next update period (T1-T2) when VCE=−7.5V, the pixel can be driven to black (TB), e.g. when Vpx=+7.5V (VEink=−15V) or maintain its current state when Vpx=VCE=7.5V (VEink=0V), or be driven more slowly TB: Vpx=0V (VEink=−7.5V).

Accordingly, common driver 570 provides a common voltage waveform VCE for driving the pixel towards one of two extreme pixel states R0, R3, depending on the common waveform polarity VCEw, VCEb. A price to pay for this drive mode is that pixels connected to the same common terminal 102 cannot be driven simultaneously to black and to white. The alternating common voltage can be viewed as a heartbeat of the display that is in synch with the update period of the pixels. This synchronicity means that the common voltage waveform period should be an integer number times the consecutive and/or single pixel update waveform period, e.g. the common voltage period fits N times in the update period. For example the common voltage changes polarity N times during the update period. For example, if N=0, the common voltage changes polarity only at the beginning of an update period, or for N=1, it switches polarity once during the update period, meaning that e.g. VCE>0 during the first half of the update period and VCE<0 during the other half.

With respect to the switch from single waveform to consecutive driving (T0'), it is noted that the common driving 'heartbeat' VCE of the system may accelerate in the consecutive driving phase (compare VCE in 1510 with VCE in 1520). The heartbeat of a system is typically maintained by a central clock that keeps track of the update periods. Thus, also in the absence of an alternating common voltage, a clock that times the update periods may be accelerated in the consecutive drive phase compared to the single waveform drive phase. E.g. in another embodiment, high voltage driving (HVD) allows driving of pixels to White and to Black simultaneously. During a full frame e.g. either +15V (to Black) or −15V (to White) is written on a pixel and the common voltage may be held at 0V.

When comparing the transition P0-P1 in the single driving period 1510 with the equivalent consecutive transition P0'-P5' it is noted that the alternating common voltage may cause the consecutive transition to be held at consecutive pixel states when the common driving voltage is driving the pixel in the wrong direction (in this case TB). This is achieved by applying a pixel voltage Vpx equal to the common voltage VCE during such periods (e.g. T1'-T2', T3'-T4', T6'-T7', T9'-T10'.

Also in a consecutive drive update period 1111, the waveform may comprise a sequence of voltage pulses that may be applied during one or more frames of the update period. E.g. a waveform w12 shown in FIG. 15 in a sub-update period 11 comprising 7 frames could comprise a voltage of 5 frames Vpxw (e.g. −7.5V) and 2 frames Vpx0 (e.g., 0V) resulting in a driving voltage VEink of +15V and +7.5V respectively. In another example, the waveform w23' (T2'-T3') may comprise, by way of example, 3 frames Vpxw, 2 frames Vpx0, and 2 frames Vpxb (e.g., VEink=+15V, +7.5V, 0V, respectively). Again, when Vpx=VCE the driving voltage VEink=0 and the pixel state remains constant. This may be used e.g. when a faster transition is finished before the end of a (sub) update period.

Since the update periods in the consecutive drive phase 1520 and the single update drive phase 1510 differ, image controller 515 controls the common voltage waveform period T1, T1' to be an integer number of the consecutive update period.

Consecutive driving of a display allows for several different advantages over standard driving. From a display perspective, the amount of update seconds needed to update a display for normal usage scenarios can be reduced, increasing overall product life of a display and decreasing power consumption. From a user perspective, the electrophoretic display will appear more responsive and will show faster updating in a number of situations where this is critical, such as during movement in document lists, moving cursors or text editing.

The various embodiments offer certain advantages, such as lowering the response time of the display. Of course, it is to be appreciated that any one of the above embodiments or processes may be combined with one or with one or more other embodiments or processes to provide even further improvements in finding and matching users with particular personalities, and providing relevant recommendations.

It is understood that this invention is especially suited for applications with electrophoretic displays, e.g., E Ink or SiPix, however in general the invention can be applied for any display type that is bistable and not too fast when responding to changes in individual pixel display states.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims. In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same or different item(s) or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

What is claimed is:

1. An electrophoretic display device comprising:

an electrophoretic pixel to be updated within a pixel update period from an initial pixel state to an update pixel state;

a first part of a memory device storing a lookup table for storing voltage waveforms corresponding to pixel updates between pixel states;

a voltage driver for supplying at least one of the voltage waveforms of the lookup table across the pixel;

an image controller controlling the voltage driver and comprising a second part of the memory device, the image controller arranged for receiving the update pixel state and storing said initial and update pixel state in the second part of the memory device;

wherein the image controller is programmed to execute, in a consecutive drive phase, during the pixel update period, repeatedly the steps of:

retrieving the initial pixel state and update pixel state from the second part of the memory device, matching, when the initial and update pixel states are different, from the set of waveforms in the lookup table, a consecutive wave form and a corresponding consecutive pixel state, according to a path defined by the consecutive drive phase, from the initial pixel state to the update pixel state, wherein the transition between the initial pixel state and the consecutive pixel state is within a consecutive update period when the consecutive pixel state is not adjacent to the initial pixel state, storing the consecutive pixel state in the second part of the memory device as a new initial pixel state; and controlling the voltage driver to drive the pixel from the initial pixel state to the consecutive pixel state by supplying said consecutive waveform to the pixel during a consecutive update period so as to provide a consecutive update period smaller than the pixel update period, wherein the image controller is programmed to execute, in a single update drive phase differing from the consecutive drive phase, during the pixel update period, the steps of:

retrieving the initial pixel state and update pixel state from the second part of the memory device, retrieving a single pixel update waveform from the lookup table, matching a transition from the initial pixel state to the update pixel state, and controlling the voltage driver to drive the pixel from the initial pixel state to the update pixel state using said single waveform; and wherein the image controller is switchable between the single update drive phase and the consecutive drive phase.

2. The display device according to claim 1, wherein the set of update pixel states have a pixel state ordering that is equidistant in a dynamic range as perceived by a human eye and wherein the lookup table stores additional waveforms for pixel updates to or from intermediate pixel states that are unequidistant to the set of update pixel states.

3. The display device according to claim 2, wherein the intermediate pixel state is adjacent an extreme pixel state according to the equidistant ordering.

4. The display device according to claim 1, wherein the image controller is arranged, in the consecutive drive phase, to update a pixel to a consecutive pixel state that is adjacent the initial pixel state.

5. The display device according to claim 1, wherein the image controller is arranged, in the consecutive drive phase, to update a pixel, with each path monotonically changing according to the pixel state ordering so as to minimize the display response time.

6. The display device according to claim 1, wherein the image controller is arranged, in the consecutive drive phase, to update a pixel, with each path having an extreme pixel state according to the pixel state ordering so as to reset a pixel state.

7. The display device according to claim 1, wherein the image controller is arranged to retrieve, in the consecutive drive phase, a modified update pixel state at any time during the consecutive update period.

8. The display device according to claim 7, further comprising image processing circuitry arranged to switch the image controller to the consecutive drive phase, to update at least an area of pixels, said area being designated by the presence of a motion effect detected by the image processing circuitry.

9. The display device according to claim 7, further comprising a user interface for receiving user input to be displayed at least during a receiving interval, wherein the user interface is arranged to switch the image controller to the consecutive drive phase at the beginning of the receiving interval.

10. The display device according to claim 1, wherein the single pixel update period ranges between 200 and 400 ms, and wherein the consecutive update period is less than 200 milliseconds.

11. The display device according to claim 1, wherein the display device further comprises a common electrode driver, said common driver providing a common voltage waveform for driving the pixel, in any of the consecutive or single update drive phases, towards one of two extreme pixel states depending on the common waveform polarity; and wherein the image controller controls the common voltage waveform period to be an integer number times the consecutive update period.

12. The display device according to claim 1, configured such that in the single pixel update phase, the pixel state is driven from the initial pixel state to the update pixel state via a direct path that changes monotonically in reflection.

13. A method for controlling an electrophoretic display device wherein an electrophoretic pixel is updated within a pixel update period from an initial pixel state to any of a set of update pixel states; the method comprising executing, in a consecutive drive phase, during a pixel update period, repeatedly the steps of:

retrieving an initial pixel state and an update pixel state from a memory, matching, when the initial and update pixel states are different, from a set of waveforms in a lookup table, a consecutive wave form and a corresponding consecutive pixel state, according to a path defined by the consecutive drive phase, from the initial pixel state to the update pixel state, wherein the transition between the initial pixel state and the consecutive pixel state is within a consecutive update period when the consecutive pixel state is not adjacent to the initial pixel state, storing the consecutive pixel state in the memory as a new initial pixel state;

controlling a voltage driver to drive the pixel from the initial pixel state to the consecutive pixel state by supplying said consecutive waveform to the pixel during a consecutive update period so as to provide a consecutive update period smaller than the pixel update period; and executing, in a single pixel update drive phase differing from the consecutive drive phase, during the pixel update period, the steps of:

retrieving the initial pixel state and update pixel state from the memory, retrieving a single pixel update waveform from the lookup table, matching a transition from the initial pixel state to the update pixel state, and controlling the voltage driver to drive the pixel from the initial pixel state to the update pixel state using said single waveform; and wherein an image controller is switchable between the single drive phase and the consecutive drive phase.

14. The display method according to claim 13, wherein the set of update pixel states have a pixel state ordering that is equidistant in a dynamic range as perceived by a human eye and wherein additional waveforms are stored in the lookup table for pixel updates to or from intermediate pixel states that are unequidistant to the set of update pixel states.

15. The display method according to claim 13, wherein, in the consecutive drive phase, a pixel is updated, with each path monotonically changing according to the pixel state ordering so as minimize the display response time.

16. The display method according to claim 13, wherein, in the consecutive drive phase, a pixel is updated, with each path having an extreme pixel state according to the pixel state ordering so as to reset a pixel state.

17. The display method according to claim 13, wherein the single pixel update period ranges between 200 and 400 ms and wherein the consecutive update period is less than 200 milliseconds.

18. The display method according to claim 13, further comprising providing a common voltage waveform to a common electrode terminal for driving the pixel, in any of the consecutive or single update drive phases, towards one of two extreme pixel states depending on the common waveform polarity; and the image controller controls the common voltage waveform period to be an integer number times the consecutive update period.

19. The display method according to claim 13, further comprising switching to the consecutive drive phase, to update at least an area of pixels, said area being designated by the presence of a detected motion effect.

20. The display method according to claim 13, further comprising receiving user input to be displayed at least during a receiving interval, and switching to the consecutive drive phase at the beginning of the receiving interval.

21. The display method according to claim 13, wherein in the single pixel update phase, the voltage driver is controlled to drive the pixel from the initial pixel state to the update pixel state via a direct path that changes monotonically in reflection.

* * * * *